US006873320B2

(12) United States Patent
Nakamura

(10) Patent No.: US 6,873,320 B2
(45) Date of Patent: Mar. 29, 2005

(54) DISPLAY DEVICE AND DRIVING METHOD THEREOF

(75) Inventor: Takashi Nakamura, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 303 days.

(21) Appl. No.: 09/945,826

(22) Filed: Sep. 5, 2001

(65) Prior Publication Data

US 2002/0036625 A1 Mar. 28, 2002

(30) Foreign Application Priority Data

Sep. 5, 2000 (JP) ..... 2000-269177

(51) Int. Cl.[7] ..... G09G 5/00; G09G 3/36

(52) U.S. Cl. ..... 345/204; 345/89; 345/99; 345/100

(58) Field of Search ..... 345/87, 89, 90, 345/92, 96, 98–100, 103, 204, 691, 692, 694, 209, 214

(56) References Cited

U.S. PATENT DOCUMENTS 5,712,652 A 1/1998 Sato et al. ..... 345/90
6,246,386 B1 * 6/2001 Perner ..... 345/90
6,288,712 B1 * 9/2001 Pinkham et al. ..... 345/204

FOREIGN PATENT DOCUMENTS

JP 08-286170 11/1996
JP 09-243995 9/1997
JP 09-243996 9/1997
JP 2000-227608 8/2000

OTHER PUBLICATIONS

Translation of Korean Official Action Notification of Reason for Rejection; Mailed Oct. 22, 2003.

Korean Official Action.

U.S patent application Ser. No. 09/945,826, Nakamura, filed Sep. 5, 2001.

U.S patent application Ser. No. 10/303,770, Nakamura et al., filed Nov. 26, 2002.

* cited by examiner

*Primary Examiner*—Jimmy H. Nguyen
(74) *Attorney, Agent, or Firm*—Oblon, Spivak, McClelland, Maier & Neustadt, P.C.

(57) ABSTRACT

A liquid crystal display device which can reduce power consumption and can be miniaturized. The liquid crystal display device according to the present invention includes a pixel array portion, an address decoder, a display memory (VRAM), and a VRAM controller, and transmits/receives a signal to/from a CPU and a peripheral circuit through a system bus. The pixel array portion has an area gradation pixel structure in which each pixel is composed of a plurality of one-bit memories. The entire pixel array portion is divided into pixel blocks each of which consists of a plurality of pixels, and the one-bit memory is rewritten in units of block. The one-bit memory has a double-word line structure.

12 Claims, 25 Drawing Sheets

| | A. FULL REWRITING | B. PARTIAL REWRITING | |
|---|---|---|---|
| | A. SEQUENITAL | B1. ROW UNIT | B2. ROW & COLUMN UNIT |
| STRUCTURE | WORD LINE<br>BIT LINE<br>FULL REWRITING | WORD LINE<br>BIT LINE<br>SPECIFIC ROW BLOCK REWRITING | DOUBLE-WORD LINE<br>COLUMN WORD LINE<br>BIT LINE<br>SPECIFIC BLOCK REWRITING |
| ROW WIRING | WORD, POLx2, Vdd, Vss | WORD, POLx2, Vdd, Vss | WORDx2, POLx2, Vdd, Vss |
| COLUMN WIRING | BIT | BIT | BIT, COLUMN WORD |
| POWER CONSUMPTION | 1 | 1~1/(NUMBER OF DIVIDED ROWS)<br>DEPENDING ON DISPLAY PATTERN | 1~1/(NUMBER OF DIVIDED ROWS)/(NUMBER OF DIVIDED COLUMNS)<br>DEPENDING ON DISPLAY PATTERN |

FIG. 19

DISPLAY DEVICE AND DRIVING METHOD THEREOF

CROSS REFERENCE TO RELATED APPLICATIONS

This application is based upon and claims the benefit of priority from the prior Japanese Patent Applications No. 2000-269177, filed on Sep. 5, 2000, the entire contents of which are incorporated herein by reference.

BACKGROUND OF THE INVENTION

1. Field of the Invention

The present invention relates to a display device, and more specifically, it relates to a technique for reducing power consumption and simplifying a circuit configuration.

2. Related Background Art

Monochrome display devices were often provided in conventional mobile instruments such as mobile phones. Recently, with increase of opportunities such as connections to an Internet using the mobile instruments, the mobile instruments having color display devices has increased.

Since power consumption in the color display device is larger than that in the monochrome display device, the color display device has a problem that an interval of battery charging of the mobile instrument is short. Furthermore, since a circuit is also complicated, miniaturization is difficult, which leads to increase in cost. In particular, it is desirable to integrally form a driving circuit on a pixel array substrate in order to reduce size of the mobile instruments. In case of the color display device, however, not only the structure of the driving circuit is complicated, but a capacity of a memory storing therein pixel data is also increased. Therefore, it is technically difficult to integrally form the driving circuit on the pixel array substrate.

Furthermore, in the prior art, since display areas are all rewritten at fixed intervals, a frequency of a pixel clock has to be accelerated as a display resolution is increased.

As a countermeasure for solving such a problem, for example, Japanese Patent Application Laid-open No. 227608/2000 discloses a technique for rewriting the display content by selecting and scanning only horizontal pixel lines in which the display content is changed.

In such control in accordance with each horizontal pixel line, however, the low-consumption power is not necessarily attained as compared with control at the time of usual driving.

SUMMARY OF THE INVENTION

In view of the above-described problems, it is an object of the present invention to provide a display device which can reduce power consumption and size of the display device.

According to the present invention, there is provided a display device comprising:

a plurality of display pixels arranged in a matrix form;

a plurality of scanning lines arranged in a row direction of said display pixels;

data lines arranged in a column direction of said display pixels;

a data line driving circuit configured to supply a data signal to said data lines;

a scanning line driving circuit configured to supply a scanning signal to said scanning lines; and a controller configured to control said data line driving circuit and said scanning line driving circuit, wherein said display pixel includes:

a sampling portion configured to sample the corresponding data signal in response to said scanning signal;

a memory portion configured to hold the corresponding data sampled by said sampling portion; and a display portion configured to perform predetermined display based on the corresponding data; and wherein when said plurality of display pixels is divided into virtual blocks having two or more display pixels arranged in the row and column directions, and the corresponding data of each display pixel in the virtual block is changed, said controller instructs selective applying of said scanning signal for said scanning line corresponding to each of said display pixels in said virtual block, to said scanning line driving circuit, so that each of said display pixel in said virtual block performs display based on the corresponding data, and when the corresponding data of each of said display pixel in said virtual block is not changed, said controller instructs prohibition of selective applying of said scanning signal for said scanning line corresponding to each of said display pixel in said virtual block, to said scanning line driving circuit, and instructs prohibition of applying of the corresponding data for said data line corresponding to each of said display pixels in said virtual block, so that each of said display pixel in said virtual block performs display based on corresponding data held in the corresponding memory portion.

BRIEF DESCRIPTION OF THE DRAWINGS

FIG. 19 is a view in which power consumption is compared between a case where the entire memory is rewritten, a case where the memory is rewritten in accordance with each line, and a case where the memory is rewritten in accordance with each row;

DESCRIPTION OF THE PREFERRED EMBODIMENTS

A display device according to the present invention will now be more specifically described hereinafter with reference to the accompanying drawings.

(First Embodiment)

Figure 1:
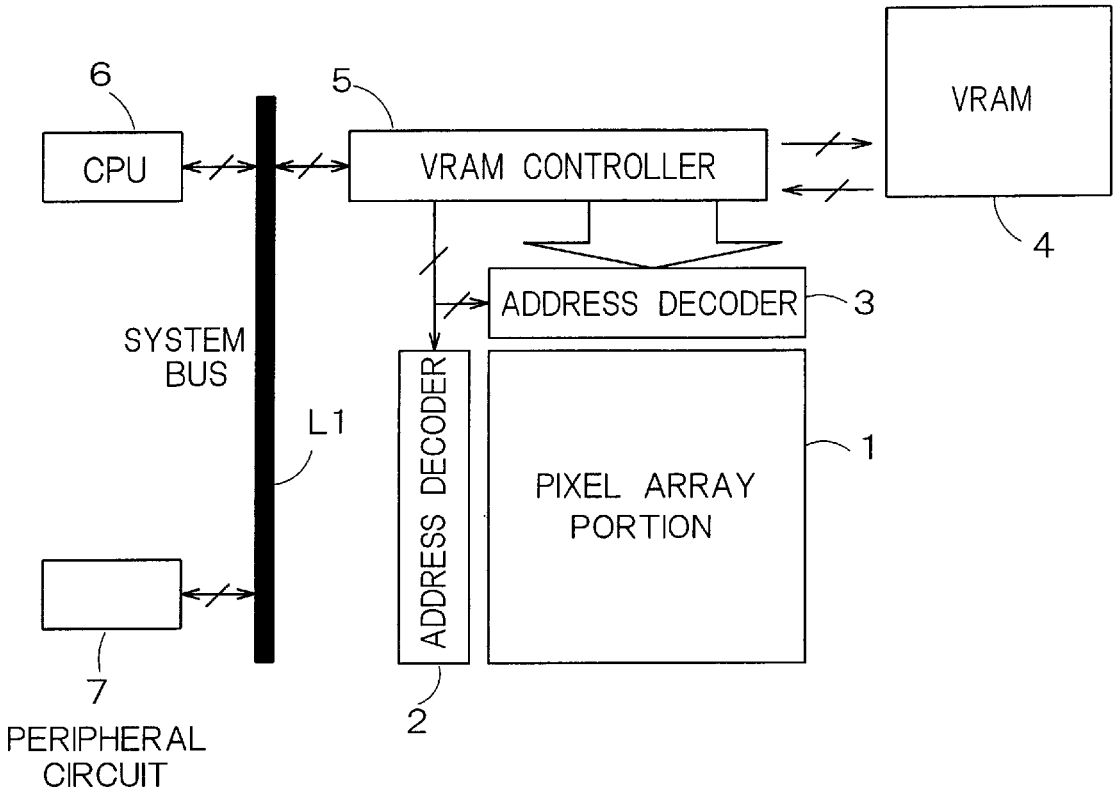
FIG. 1 is a block diagram showing a schematic configuration of an embodiment of a liquid crystal display according to the present invention.

FIG. 1 is a block diagram showing a schematic configuration of a first embodiment of a display device according to the present invention, and illustrates a structure of a liquid crystal display.

The liquid crystal display shown in FIG. 1 includes a pixel array portion 1, address decoders 2 and 3, a display memory (VRAM) 4, and a VRAM controller 5, and transmits/receives signals to/from a CPU 6 and a peripheral circuit 7 through a system bus L1.

Figure 2A:
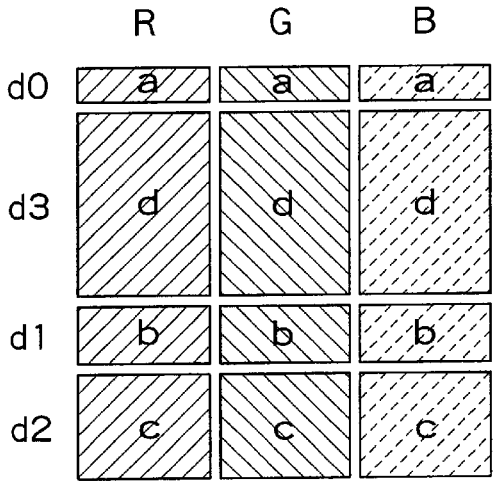
FIGS. 2A–2C are views showing a structure corresponding to one pixel.
Figure 2B:
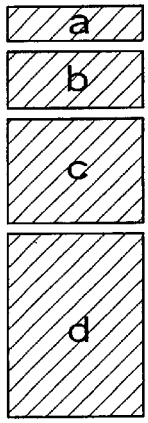
Figure 2C:
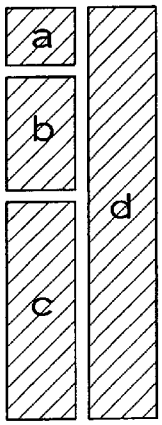

The pixel array portion 1 has a pixel structure capable of performing area gradation display in which each pixel is composed of a plurality of one-bit memories. FIGS. 2A, 2B and 2C are views showing each structure corresponding to one pixel. As shown in the drawings, one pixel is composed of four sub pixel areas in accordance with each color display pixel of RGB, and a memory for one bit is provided to each area. FIGS. 2A and 2C show examples in which one display pixel is composed of four sub pixel areas based on a display signal of four bits in accordance with each color. Assuming that a least significant bit is d0 and a most significant bit is d3, a pixel value of each pixel is represented by $2^0 \cdot d0 + 2^1 \cdot d1 + 2^2 \cdot d2 + 2^3 \cdot d3$. As a result, $2^4 = 16$ gradations can be displayed in accordance with each color.

Each one-bit memory in the sub pixel area is connected to a image electrode which is composed of Al or Ag and has, e.g., the reflectivity, respectively. For example, an opposed electrode is arranged on the top face of these reflecting image electrodes with a liquid crystal layer therebetween.

FIG. 2 show an example in which an area ratio of respective four bits from the least significant bit d0 to the most significant bit d3 is d0:d1:d2:d3=1:2:4:8. In general, it is desirable that an area of each area × the transmissivity of a white color is the exponentiation of 2. Incidentally, it is good enough that the sub pixel area composing one pixel is divided into six sub pixel areas so that a desired area ratio can be achieved in accordance with a bit number of the display signal, for example, the display signal having six bits.

As to arrangement of four sub pixel areas composing each pixel, these sub pixel areas do not have to be aligned in sequence in each display pixel. As shown in FIG. 2A, they may be aligned in the order of (d0, d3, d1, d2). Alternatively, as shown in FIG. 2B, they maybe aligned in the order of (d0, d1, d2, d3). In addition, they may be two-dimensionally aligned as shown in FIG. 2C. In this case, taking easiness of connection with respect to a memory and the structure of a color filter into consideration, it is desirable to maximize open area ratio.

Figure 3:
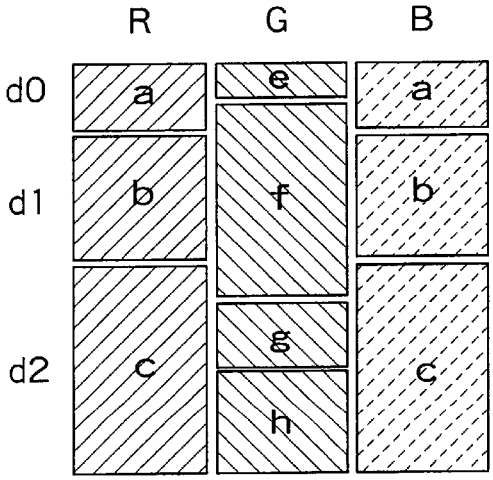
FIG. 3 is a view showing an example in which an area of each sub pixel area is different in accordance with each color of RGB.

Although FIG. 2 show the case where the number of sub display pixels composing the display pixel is equal for each color of RGB among RGB and the number of display gradations of each color is 16, the number of display gradations which can be displayed maybe different in accordance with each color. For example, FIG. 3 shows an example where each of R and B has three bits, i.e., three sub pixel area, and G has four bits, i.e., four sub pixel areas.

Although FIG. 2 have illustrated the example where the number of the sub pixel areas is equal for each color of RGB, the number of the sub pixel areas may be different from each other in RGB. Actually, it is desirable to determine the number of bits of RGB so that the most natural color shade can be obtained. Additionally, an area ratio of each sub pixel areas maybe different from each other in RGB.

The VRAM controller 5 in FIG. 1 writes video data supplied from the CPU 6 into the VRAM 4, fetches the video data from the VRAM 4 in units of pixel block, and outputs to the address decoders 2 and 3 the fetched data together with address data indicative of a pixel block coordinate. The address decoders 2 and 3 store the video data in one-bit memories of the corresponding pixel array portion 1 in the pixel block 1.

The size of the pixel block is substantially equal to the number of dots required for drawing one font. The VRAM controller 5 outputs a dividing clock for accessing the one-bit memory. Furthermore, the VRAM controller 5 can output an intermediate potential during a data pause period (blanking period).

The pixel array portion 1 includes a clock generation circuit so that the refresh operation for the one-bit memory and polarity inversion of a liquid crystal application voltage can be carried out during the data pause period.

The VRAM controller 5 is composed of a silicon chip and mounted on a glass substrate in which the pixel array portion 1 is formed by a COG (chip on glass). Alternatively, the VRAM controller 5 and the CPU 6 may be contained together in one silicon chip and mounted on the glass substrate by COG. Furthermore, the chip may be contained in the VRAM 4.

This embodiment is characterized in that the entire pixel array portion 1 is divided into pixel blocks in the two-dimensional matrix form composing a plurality of pixels and the one-bit memory of each pixel is rewritten in accordance with each block. The number of bits of a peripheral decoder circuit can be reduced by rewriting the memory in accordance with each block, thereby decreasing a packaging area of the circuit. Moreover, as a realistic problem, the memory corresponding to only one pixel is rarely rewritten. Since the memories corresponding to several tens pixels are typically collectively rewritten, even if the memories are rewritten in accordance with each block, this does not necessarily lead to the redundant operation such that the consumption power is wasted.

In addition, in this embodiment, a unit for reading from the VRAM 4 is larger than the unit for writing into the VRAM 4. As a result, the VRAM 4 can be rewritten only in a range that rewriting is necessary, and it is possible to read from the VRAM at high-speed.

As more specified example of the liquid crystal display illustrated in FIG. 1, when a character of 16 dots is displayed with the number of pixels equal to 256 (×3)×256 dots, the pixel block is formed into a two-dimensional matrix composed of 16×16 dots, and each of the address decoders 2 and 3 is determined as a four-bit decoders. Additionally, still images are composed of six bits, and standby mode liquid crystal pixel polarity inversion is performed by using a polysilicon oscillation circuit. Also, an external controller is completed paused. Furthermore, the VRAM 4, the VRAM controller 5 and the CPU 6 are contained together in one chip, and a part of a main storage memory of the CPU 6 is used as the VRAM 4. This chip is mounted on the glass board on which the pixel array portion 1 is formed by COG.

Figure 4:
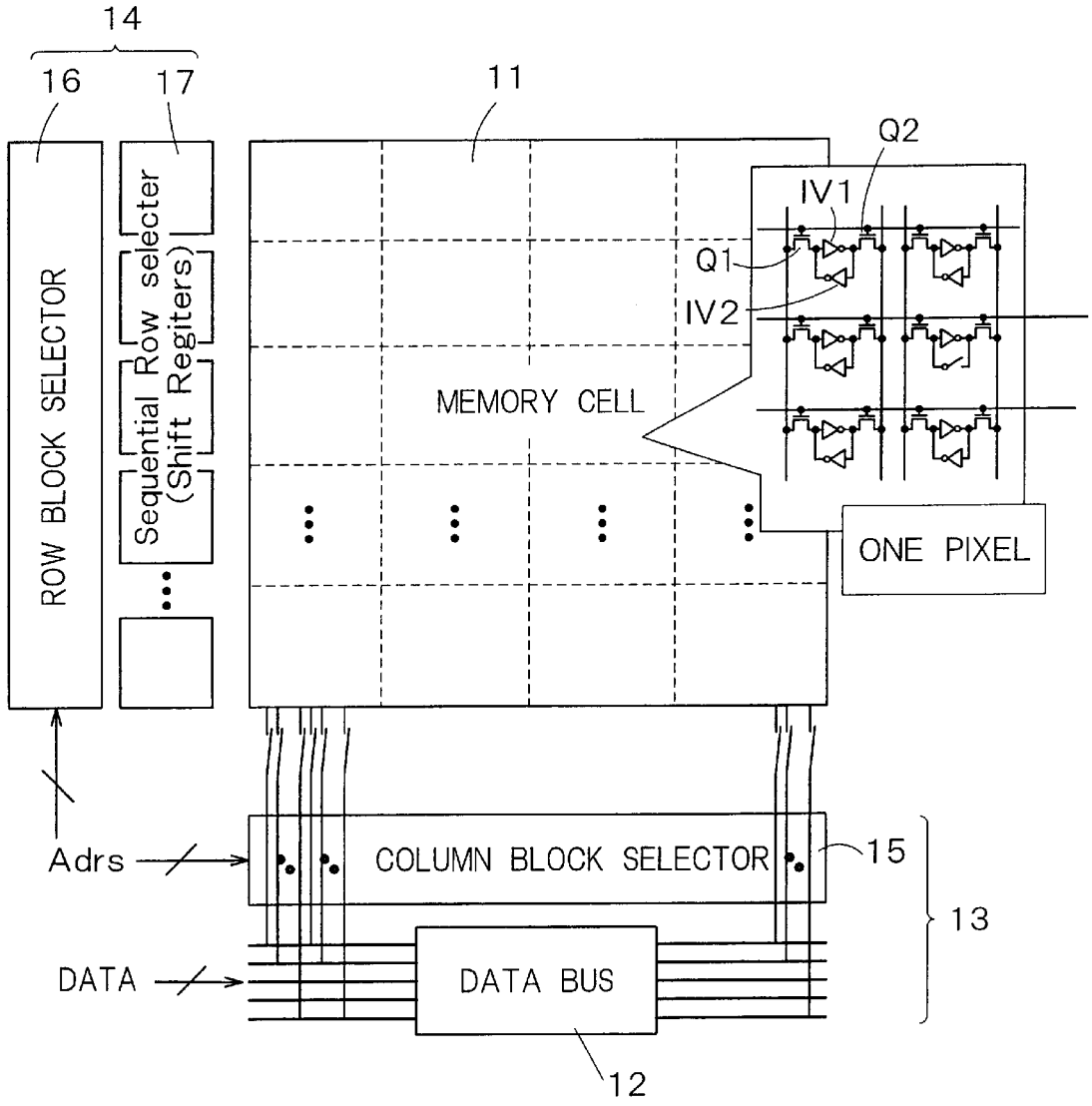
FIG. 4 is a block diagrams showing a circuit structure of the circumference of a pixel array portion 1.

FIG. 4 is a block diagram showing configuration of the pixel array portion 1 and a peripheral circuit thereof. As shown in the drawing, the pixel array portion 1 is divided into a plurality of memory cells (pixel blocks) 11 in the two-dimensional matrix form, and each memory cell 11 is composed of a plurality of pixels. Each pixel composing the memory cell 11 is composed of six sub pixels in total, of which two pairs of three sub pixels are arranged in parallel, and each of the sub pixels is weighted in area. A one-bit memory having an SRAM structure is provided to each sub pixel.

In terms of an equivalent circuit, the one-bit memory is an SRAM composed of, e.g. transistors Q1 and Q2 and inverters IV1 and IV2 as shown in the drawing, and holds data supplied from the data bus 12. A high-level voltage or a low-level voltage held in the one-bit memory is applied to the image electrode, and a difference in potential between the image electrode and a common voltage is applied to the liquid crystal layer.

A bit line driving circuit 13 and a word line driving circuit 14 are connected to the memory cell 11. The bit line driving circuit has a column block selector 15 for selecting a bit line to which the pixel data on the data bus 12 is supplied. Furthermore, the word line driving circuit 14 has a row block selector 16 and a shift register 17. The row block selector 16 selects any one of the blocks, and a shift register 17 sequentially drives word lines in the selected block.

In this embodiment, for example, transistors for pixel display and transistors for driving circuits are formed on the glass substrate as an insulating substrate by utilizing the low-temperature polysilicon technique. However, since the operation speed of the transistor formed by the low-temperature polysilicon is lower than that of a transistor made of crystallized silicon formed on a silicon wafer, a voltage amplitude must be increased. Because of this, address data or video data supplied from the outside of the glass substrate is subjected to level conversion on the glass substrate.

Figure 5:
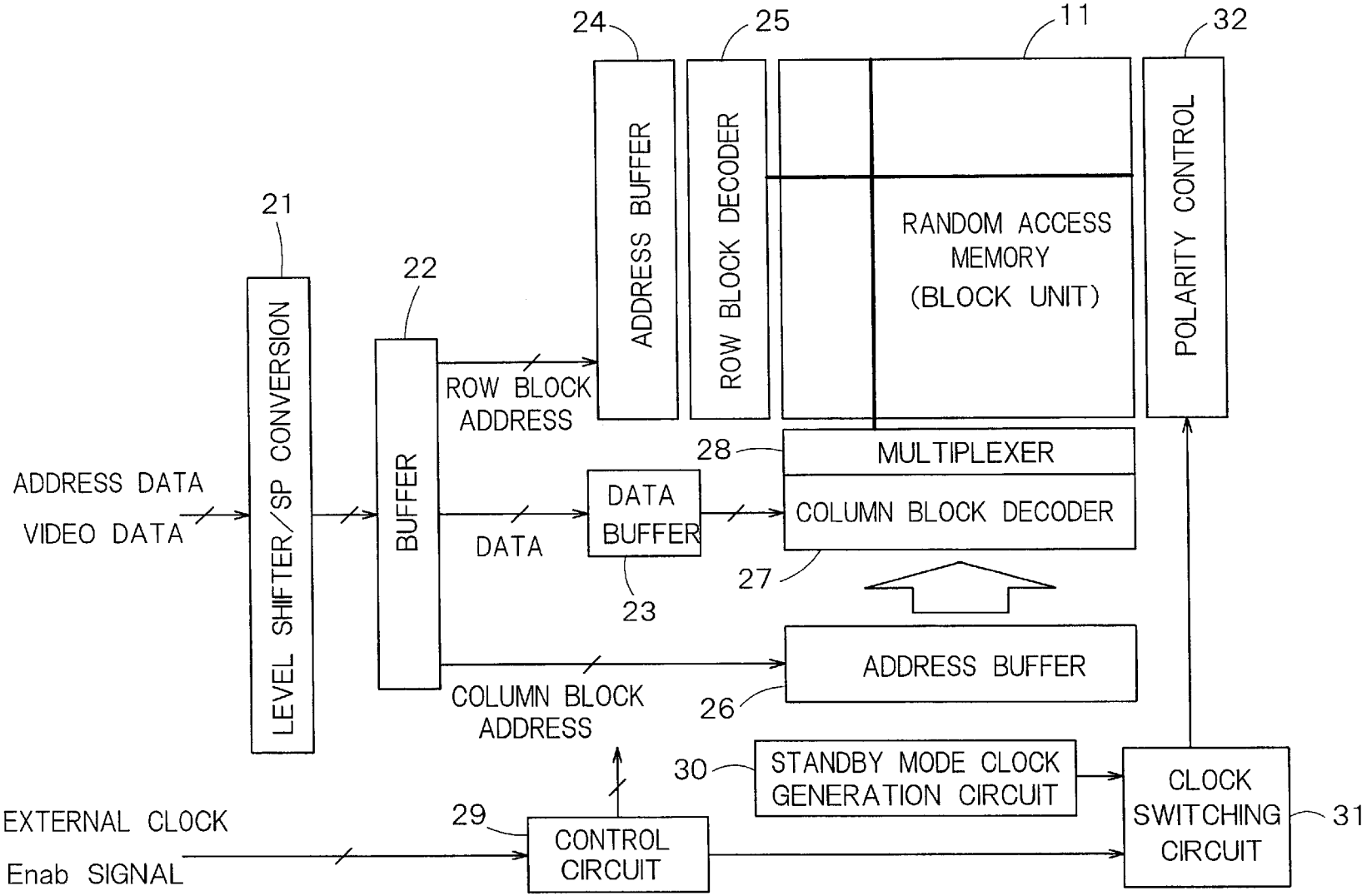
FIG. 5 is a block diagram showing a circuit structure of the circumference of a memory cell 11 in detail.

FIG. 5 is a block diagram showing configuration of the peripheral circuit of the memory cell 11 in detail. As shown in the drawing, there are provided a level shifter for carrying out level conversion of pixel data and a serial-parallel converting circuit (SP converting circuit) 21; a buffer 22; a data buffer 23; an address buffer 24 on the line side; a line block decoder 25; an address buffer 26 on the row side; a row block decoder 27; a multiplexer 28; a control circuit 29 for generating a synchronous signal and so on; a standby mode clock generation circuit 301; a clock switching circuit 31; and a polarity control circuit 32.

Data subjected to level shift by the level shifter 21 shown in FIG. 5 is divided by the serial-parallel converting circuit (SP converting circuit) 21. The SP converting circuit 21 prolongs a data period to an n-fold period (n is a natural number not less than 2) so that the timing margin in a digital circuit on the rear stage side can be readily assured.

To the glass substrate are inputted video data and block address data for specifying a block into which data is written. Since a smaller number of data buses 12 is desirable, the video data and the block address are transmitted through the same bus in this embodiment. More specifically, the address data is first transmitted and the video data is then transmitted in accordance with each block. The address data is held in the line/row address buffers 24 and 26 and determines a data path. In addition, the video data is stored in the data buffer 23 and transmitted to the signal line in the pixel array portion 1 through the multiplexer 28 in a predetermined order.

In case of performing liquid crystal display by using the one-bit memory such as shown in FIG. 2, display must be continued even in the standby mode. However, since burning and the like of the liquid crystal occurs when a direct-current voltage is applied to the liquid crystal for a long period, the polarity inversion operation must be carried out at predetermined intervals even in the standby mode. In this embodiment, therefore, as shown in FIG. 5, a standby mode clock generation circuit 30 is provided so that polarity inversion in the standby mode is carried out at a speed which is slower than an usual speed, for example, polarity inversion is carried out in one vertical scanning cycle in the usual drive mode and the polarity inversion is performed in four vertical scanning cycles in the standby mode. By providing such a standby mode clock generation circuit 30, it is possible to completely stop the system clock in the standby mode, thereby reducing the power consumption.

Specific Example 1 of Memory and Polarity Inverting Circuit

Figure 6:
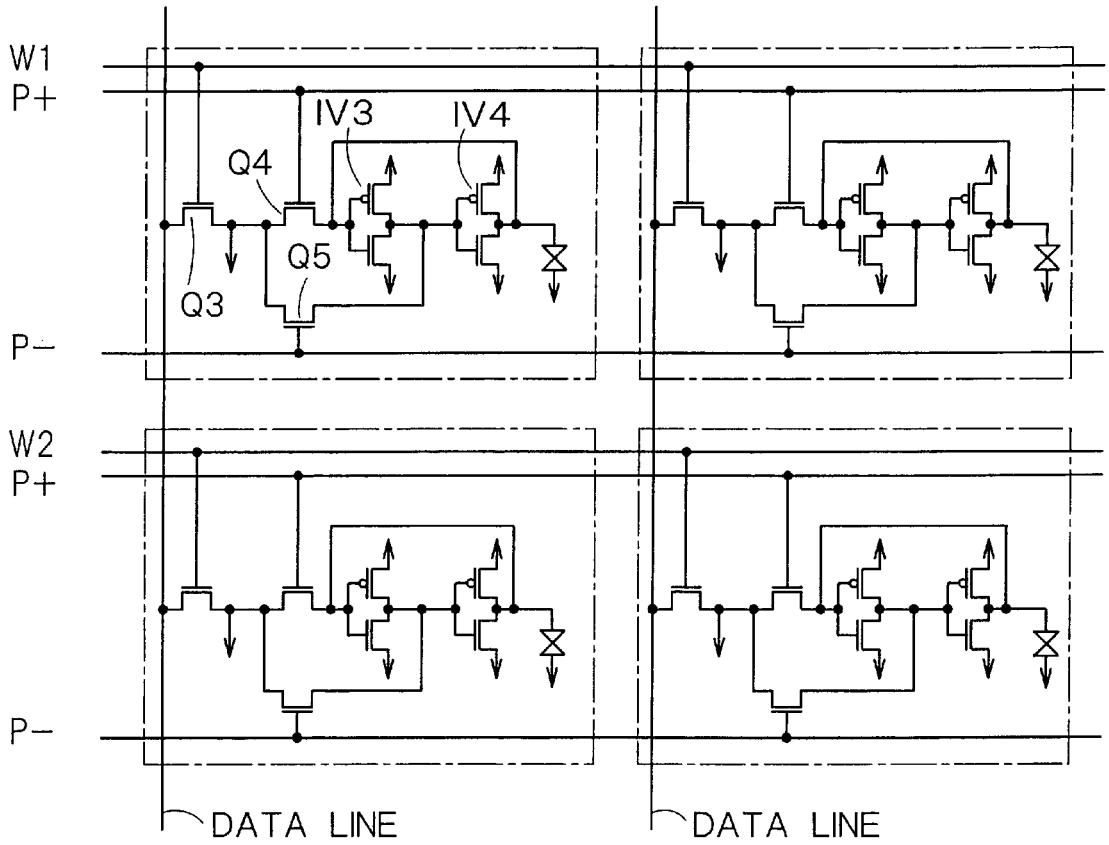
FIG. 6 is a circuit diagram showing a structure in which an SRAM and a polarity inverting circuit are provided in accordance with each sub pixel.

FIG. 6 is a circuit diagram showing configuration of a liquid crystal display in which an SRAM and a polarity inverting circuit are provided in accordance with each sub pixel having a weighted display area. Parts surrounded by dashed lines in FIG. 6 indicate respective sub pixels. To each sub pixel are connected a word line, polarity control lines P+ and P− and a data line, and each sub pixel has a single-word line structure. Each sub pixel has a transistor Q3 which is turned on/off by a potential of the word line, a transistor Q4 which is turned on/off by a potential of the polarity control line P+, a transistor Q5 which is turned on/off by a potential of the polarity control line P−, and inverters IV3 and IV4 connected in cascade. The transistor Q3 and the inverters IV3 and IV4 constitute an SRAM, and the transistors Q4 and Q5 form a polarity inverting circuit.

The circuit of FIG. 6 is relatively simple. By combining random access circuits for each line or for a plurality of lines and random access circuits having the two-dimensional matrix form, the power consumption can be greatly reduced as compared with the case that the entire screen is always updated. However, there may occur problems that erroneous writing is apt to be generated, the load on the word line becomes large, and the power consumption increases. As a technique for avoiding such problems, a double-word line structure can be combined as follows.

Specific Example 2 of Memory and Polarity Inverting Circuit

Figure 7:
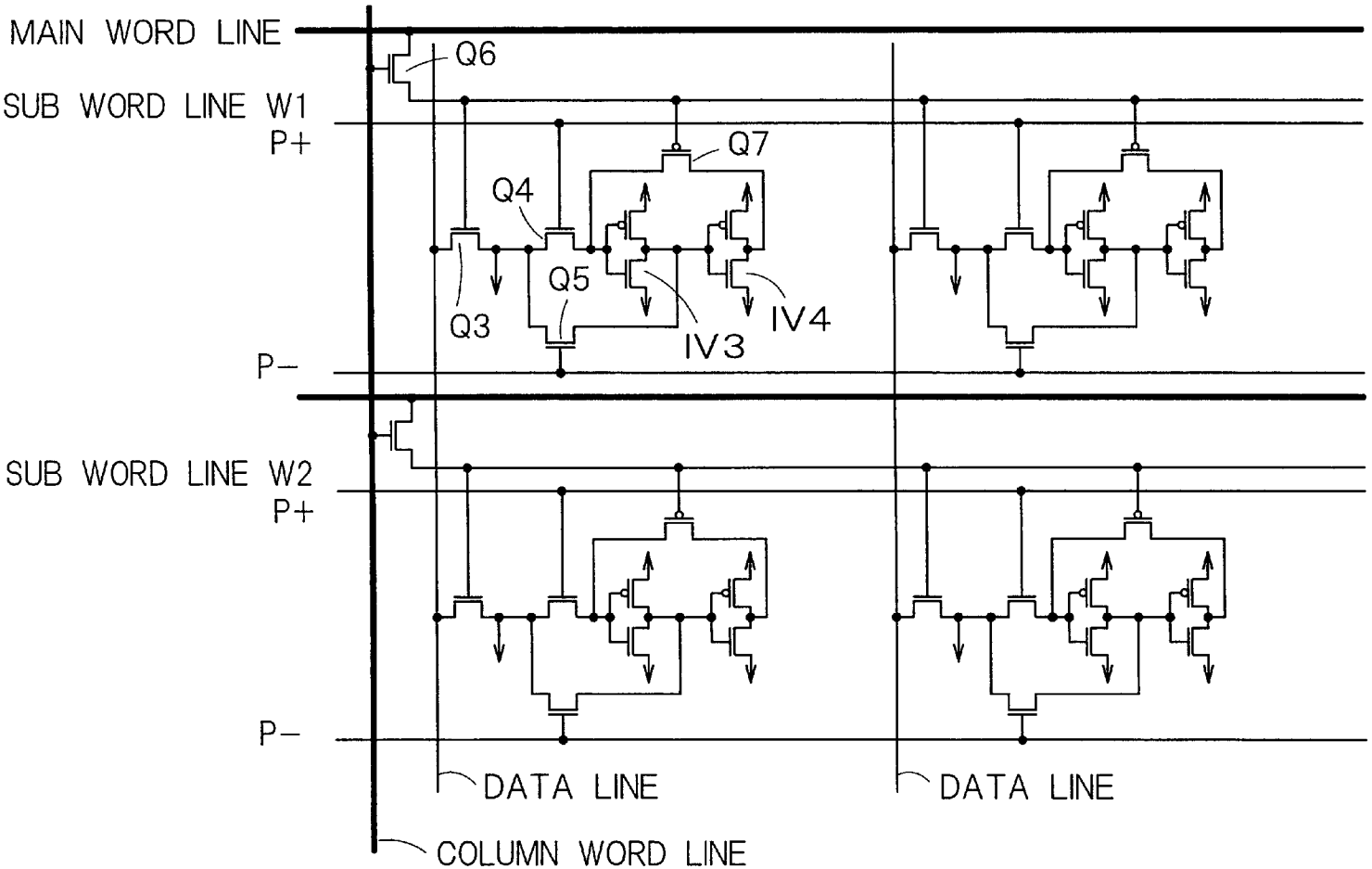
FIG. 7 is a circuit diagram showing a structure of a double word line.

FIG. 7 is a circuit diagram of a double-word line structure. The circuit shown in FIG. 7 has a transistor Q6 which is turned on/off by the potential of a column word line. When the transistor Q6 is turned on, the potential of the main word line is supplied to the sub word line. The sub word line is connected to each of the sub pixels aligned in the row direction. For example, when the sub word line is on the high level, a transistor Q3 is turned on, and a transistor Q7 provided in a feedback path of the SRAM is turned off. At this moment, either the transistor Q4 or Q5 is turned on by the potential of the polarity control lines P+ and P−.

On the other hand, when the sub word line is on the low level, the transistor Q7 is turned on, and an inverter output on the rear stage side in the SRAM is fed back to the input of the inverter on the first stage side, thereby holding data.

As described above, in the double word line structure, the sub word line of only the block which is a target of updating becomes active, and any other sub word lines become inactive. Therefore, erroneous writing hardly occurs.

Figure 8:
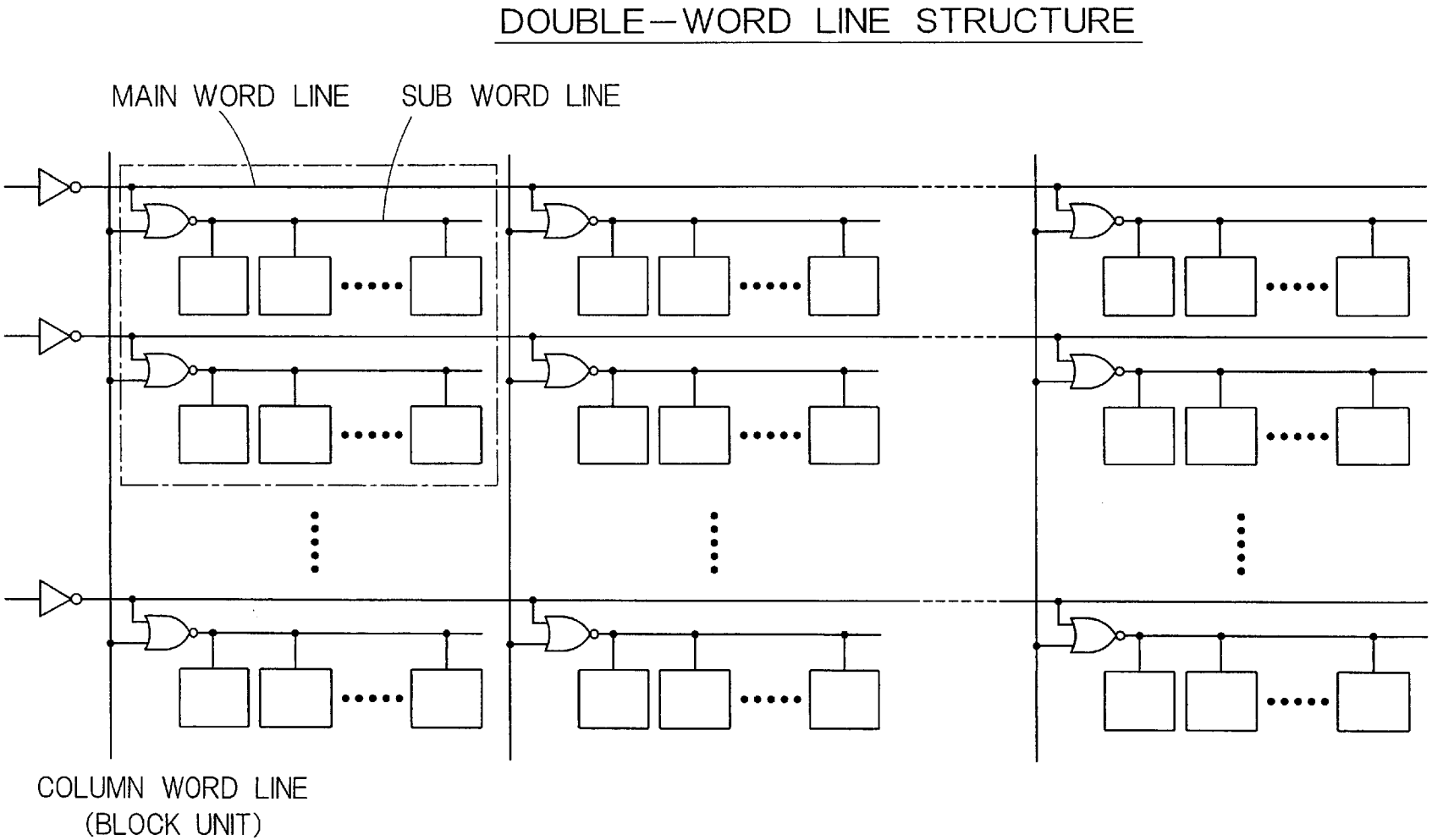
FIG. 8 is a view for illustrating a structure of a double word line.

FIG. 8 is a view for illustrating the double-word line structure. An area surrounded by a dashed line in FIG. 8 is a block indicating a data rewriting unit. As shown in the drawing, only any one sub word line becomes active by the potential of the main word line and the column word line. Furthermore, respective one-bit memories in the selected block are sequentially driven. It is to be noted that the unit of block is not restricted to a specific range and it may extend across multiple lines.

Specific Example 3 of Memory and Polarity Inverting Circuit

Figure 9A:
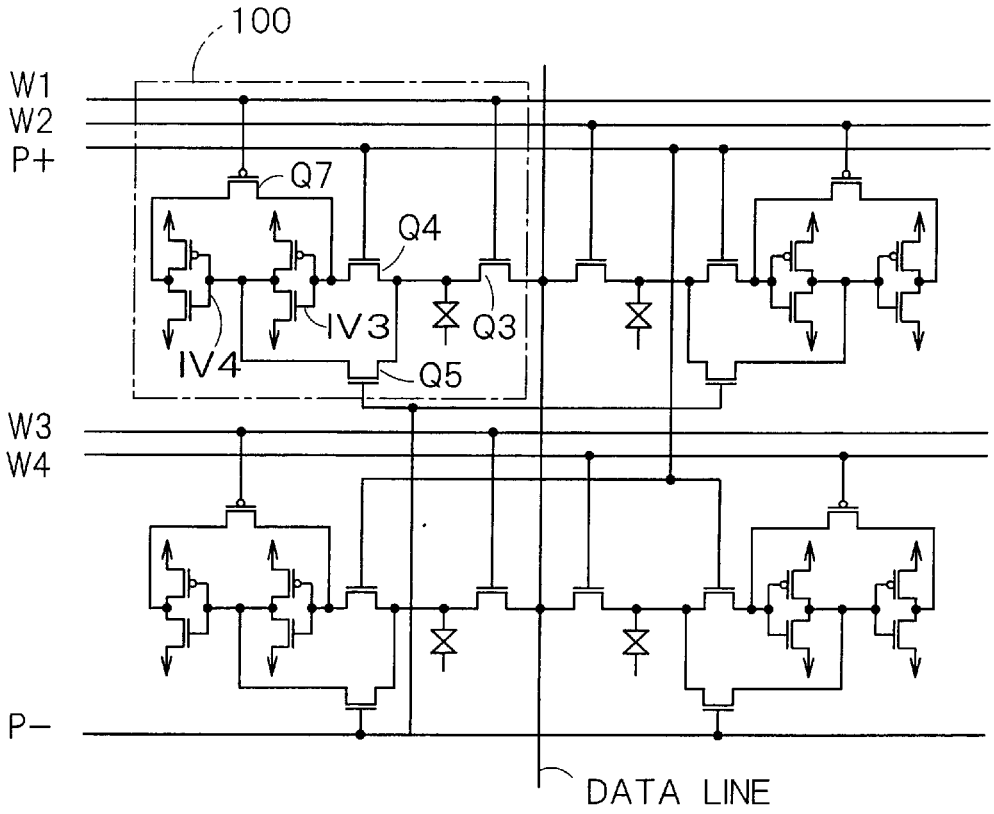
FIGS. 9A–9B are circuit diagrams showing examples in which a data line and polarity control lines P+ and P− are shared.
Figure 9B:
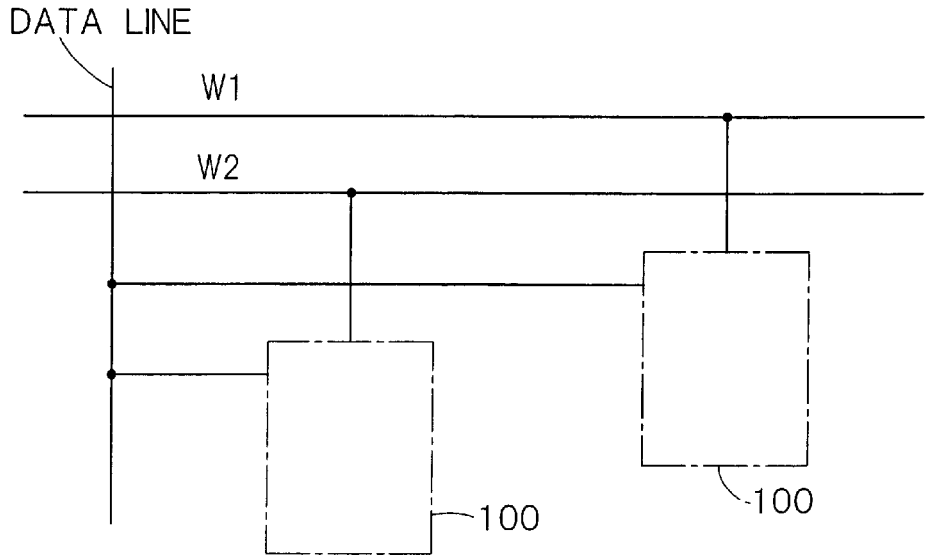

FIG. 9A is a circuit diagram showing an example in which the data line and the polarity control lines P+ and P− are shared by adjacent pixels. The circuit shown in FIGS. 9A–9B are an example that four weighted sub pixels composes one pixel and 16-gradation display is realized by each pixel. Four sub pixels are arranged so that each two sub pixels are provided in the both vertical and horizontal directions, and two sub pixels adjacent to each other in the horizontal direction are arranged through the data line and share this data line. The sub pixel has a transistor Q3 connected to the data line, an SRAM and a polarity inverting circuit. The SRAM has transistors Q4 and Q5 and inverters IV3 and IV4, and the polarity inverting circuit has transistors Q4 and Q5.

In the circuit shown in FIGS. 9A–9B, since the sub pixels 100 adjacent to each other in the horizontal direction share the data line, separate word lines must be connected to the respective two sub pixels 100. That is, more word lines are required as compared with the circuit shown in FIG. 7. On the other hand, the polarity control lines P+ and P− are commonly connected to all of the four sub pixels 100 arranged in the vertical and horizontal directions.

Meanwhile, although FIG. 9A has illustrated the example in which the data line is arranged between the two sub pixels 100 adjacent to each other in the horizontal direction, the data line may be arranged at the left end (or the right end) of the two sub pixels 100 adjacent to each other as shown in FIG. 9B.

(Structure of Display Controller)

It is often the case that the VRAM 4 and the VRAM controller 5 shown in FIG. 1 are contained together in one chip.

Figure 10:
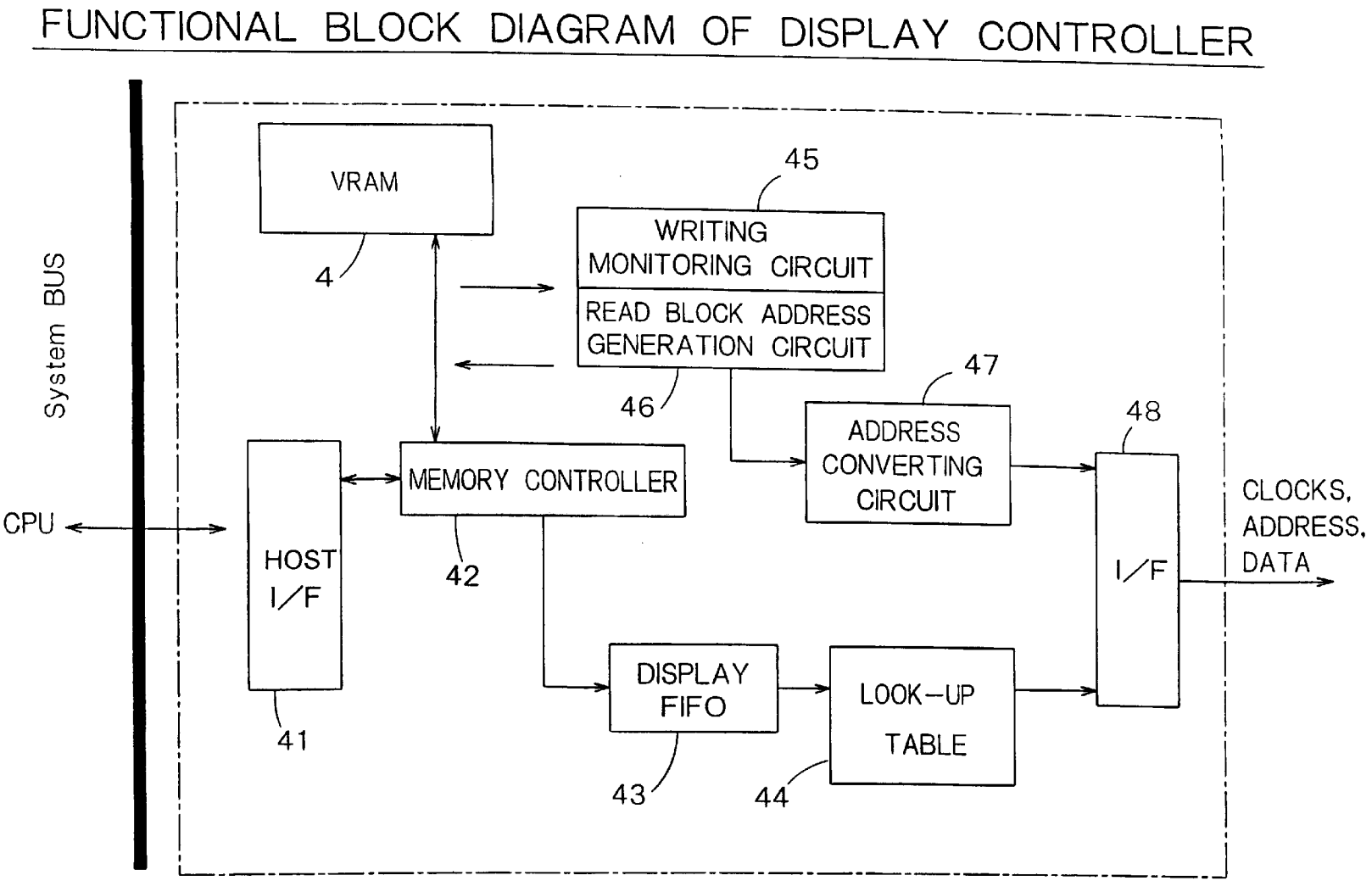
FIG. 10 is a block diagram showing a display controller in which a VRAM 4 and a VRAM controller 5 are contained together in one chip.

FIG. 10 is a block diagram showing a display controller in which the VRAM 4 and the VRAM controller 5 are contained together in one chip. The illustrated display controller has: a host interface (host I/F) portion 41 for transmitting/receiving data to/from the CPU 6; a memory controller 42; a display FIFO 43; a look-up table 44; a VRAM 4; a writing monitoring circuit 45; a read block address generation circuit 46; an address converting circuit 47; an interface (I/F) portion 48 for transferring data to the address decoders 2 and 3 depicted in FIG. 1.

The writing monitoring circuit 45 monitors whether the CPU 6 has rewritten the content of the VRAM 4. When the content of the VRAM 4 has been rewritten, the read block address generation circuit 46 generates addresses for the pixel block including the pixels which has been rewritten within a predetermined time.

The address converting circuit 47 converts a VRAM space address specified by the CPU 6 into a block address for display. The look-up table 44 converts the color gradation data specified by the CPU 6 into data for the one-bit memory.

(Writing Small Amplitude to Single Data Line Memory)

In the case of the above-described circuit shown in FIG. 7, when writing data into the one-bit memory, the transistor Q7 is turned off to cut the memory loop. The amplitude of the data supplied to the data line can be minimized by such control. In this case, irregularities of threshold values of the inverters IV3 and IV4+$\alpha$ a can suffice the amplitude of the data. For example, assuming that the threshold values of the inverters IV3 and IV4 is 2.5 V±0.3 V with taking irregularities of the device into consideration, the data line is recognized as being on the low level in the case of not more than 2.2 V and as being on the high level in the case of not less than 2.8 V.

Figure 11:
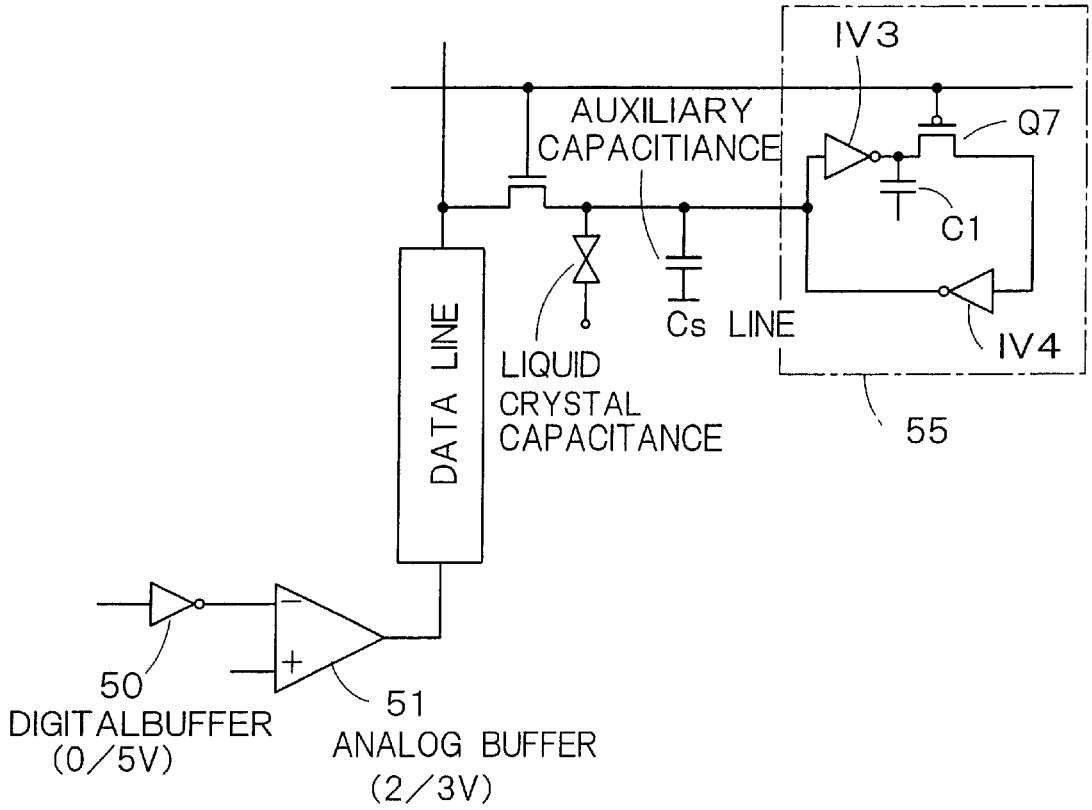
FIG. 11 is a view showing an example in which level shift is carried out by an analog buffer.

Thus, as shown in FIG. 11, after an output of the digital buffer 50 having an amplitude of 0V to 5V is level-shifted into a signal having an amplitude of 2 V to 3V, this signal is supplied to the one-bit memory 55. As a result, the power consumption can be reduced.

Furthermore, it is desirable to connect the capacitance C1 to anywhere in the one-bit memory 55. Since the writing level is dynamically held in the capacitance by adding such a capacitance C1 even after the word line is turned off, even if the operation of the inverter loop is unstable when the delay of the inverters IV3 and IV4 is large and the word line is activated, the operation can reach the stable state after a while. It is to be noted that the capacitance C1 does not have to be externally provided and a capacitance which is parasitic on the circuit, a liquid crystal capacitance or an auxiliary capacitance Cs is also effective.

Furthermore, when the amplitude of the digital data having an amplitude of 0 V to 5 V is reduced to 2 V to 3 V or 1 V to 4 V by the analog buffer 51, power consumed by the bus wiring for data distribution can be lowered. An easy method for connecting the 1-V to 4-V power supply line to the data line in accordance with low/high of the signal is also possible instead of the analog buffer, and the loss of the power consumption becomes small as compared with the case where the analog buffer is composed of the polysilicon TFT having the large irregularities in characteristics.

Figure 12:
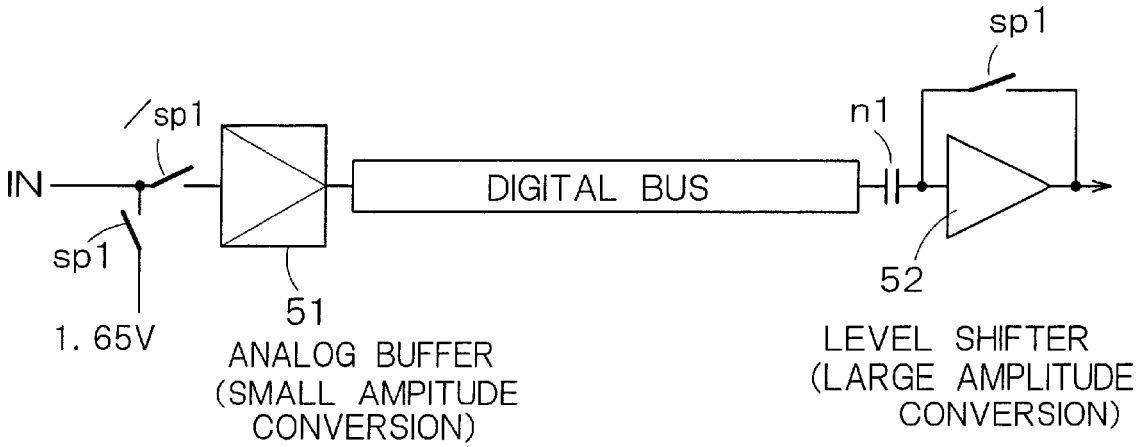
FIG. 12 is a view showing an example in which a level shifter 52 for converting into a large amplitude is provided on a rear stage side of an analog buffer 51 for converting into a small amplitude.

On the other hand, the logic circuit such as a multiplexer shown in FIG. 5 has to be driven with a relatively large amplitude. Therefore, as shown in FIG. 12, a level shifter 52 for converting the amplitude into a large counterpart must be provided on the rear stage side of the analog buffer 51 for converting the amplitude into a small counterpart.

Figure 13:
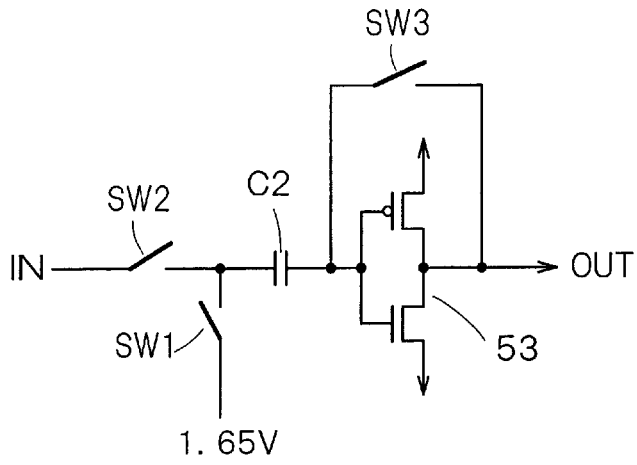
FIG. 13 is a circuit diagram showing an example of a level shifter.
Figure 14:
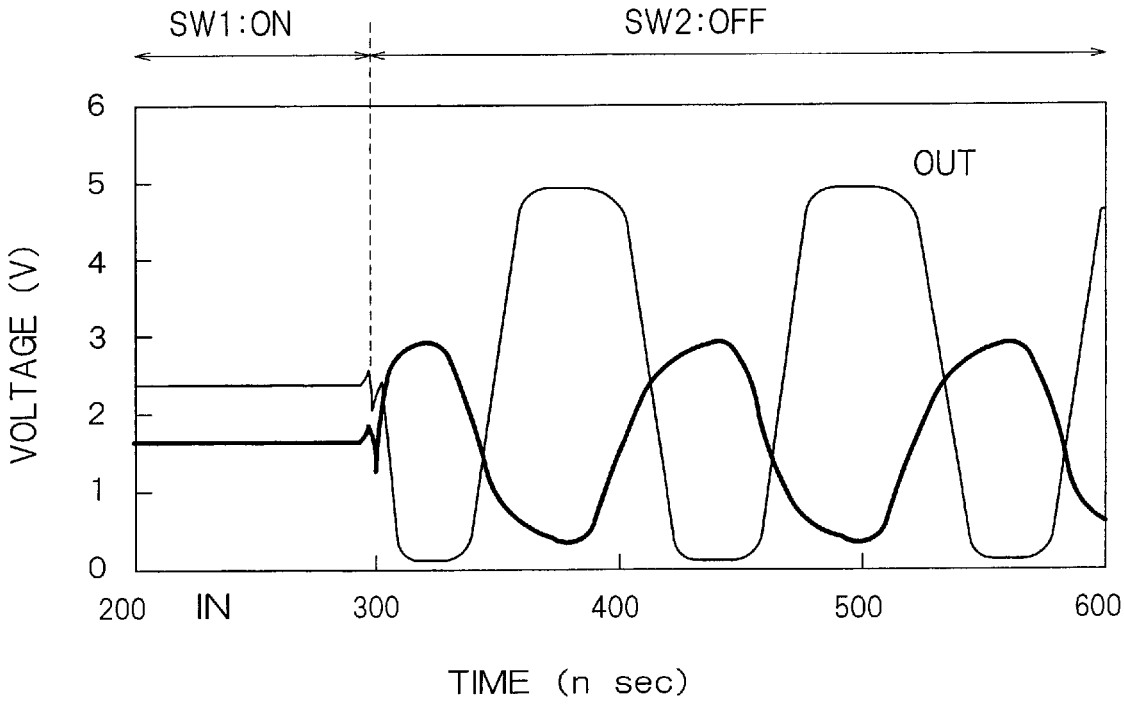
FIG. 14 is a view showing input/output waveforms of the circuit illustrated in FIG. 13.

FIG. 13 is a circuit diagram showing an example of the level shifter 52, and FIG. 14 is a view showing input/output waveforms of the circuit illustrated in FIG. 13. In FIG. 14, a switch SW1 is in the on state while a switch SW2 is in the off state up to 300 nsec. Therefore, the left electrode of the capacitor C2 in FIG. 13 has 1.65 V. Moreover, at this moment, since the input/output terminals of the inverter 53 are conducted through a switch SW3, the input/output terminals of the inverter 53 have a voltage which is substantially equal to a threshold voltage.

After 300 nsec, the switch SW1 is in the off state while the switch SW2 is in the on state. As a result, the voltage is converted into a voltage in accordance with irregularities in the threshold value.

Figure 15:
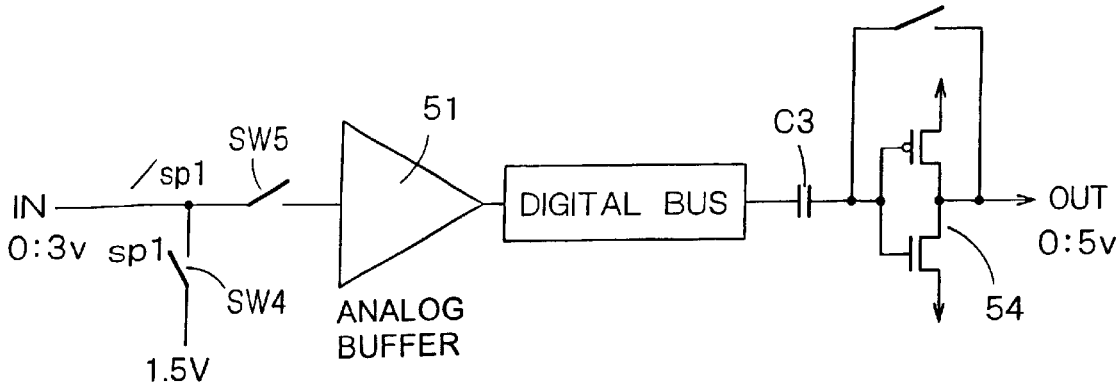
FIG. 15 is a circuit diagram showing the circumference of the analog buffer 51 in detail.

FIG. 15 is a circuit diagram showing the peripheral circuit of the analog buffer 51 in detail. Switches SW4 and SW5 are connected to the input terminal of the analog buffer 51, and an inverter 54 is connected to the output terminal of the analog buffer 51 through the capacitor C3.

Figure 16A:
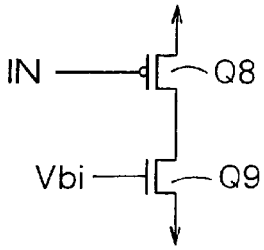
FIGS. 16A–16B are circuit diagrams showing a specific structure of the analog buffer.
Figure 16B:
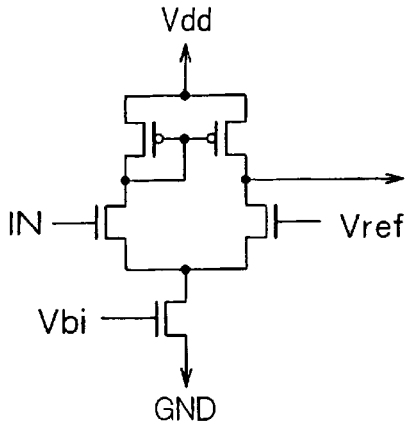

The analog buffer 51 is composed of two transistors Q8 and Q9 such as shown in FIG. 16A in the simple manner. Alternatively, a differential amplification circuit configuration may be provided as shown in FIG. 16B.

Figures 17A, 17B, 17C:
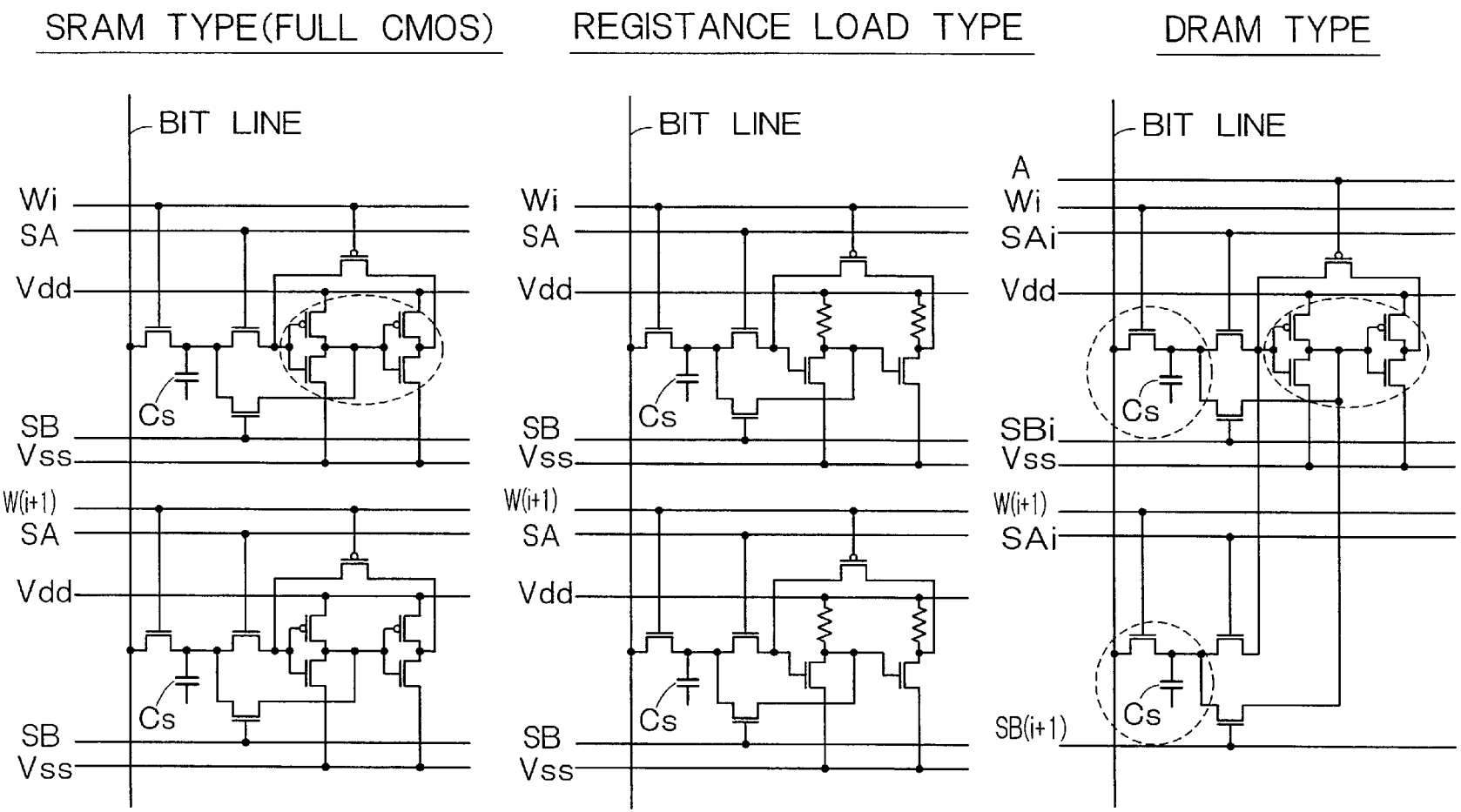
FIGS. 17A–17C are views showing structures of a one-bit memory.

In the above-described embodiment, although description has been given as to the example in which the one-bit memory in the pixel array portion 1 has the SRAM structure, a DRAM structure or a resistance load type structure may be provided. FIGS. 17A, 17B and 17C are views showing structures of the one-bit memory. FIG. 17A shows an example of the SRAM structure, FIG. 17B shows an example of the resistance load type structure, and FIG. 17C shows an example of the DRAM structure.

The resistance load type structure shown in FIG. 17B can be obtained by substituting the PMOS transistor of the inverter composing the SRAM by the resistance. In addition, in the case of the DRAM structure shown in FIG. 17C, besides the DRAM parts indicated by dotted lines, circuits for carrying out refresh and polarity inversion are provided for every plural bits.

Figure 18:
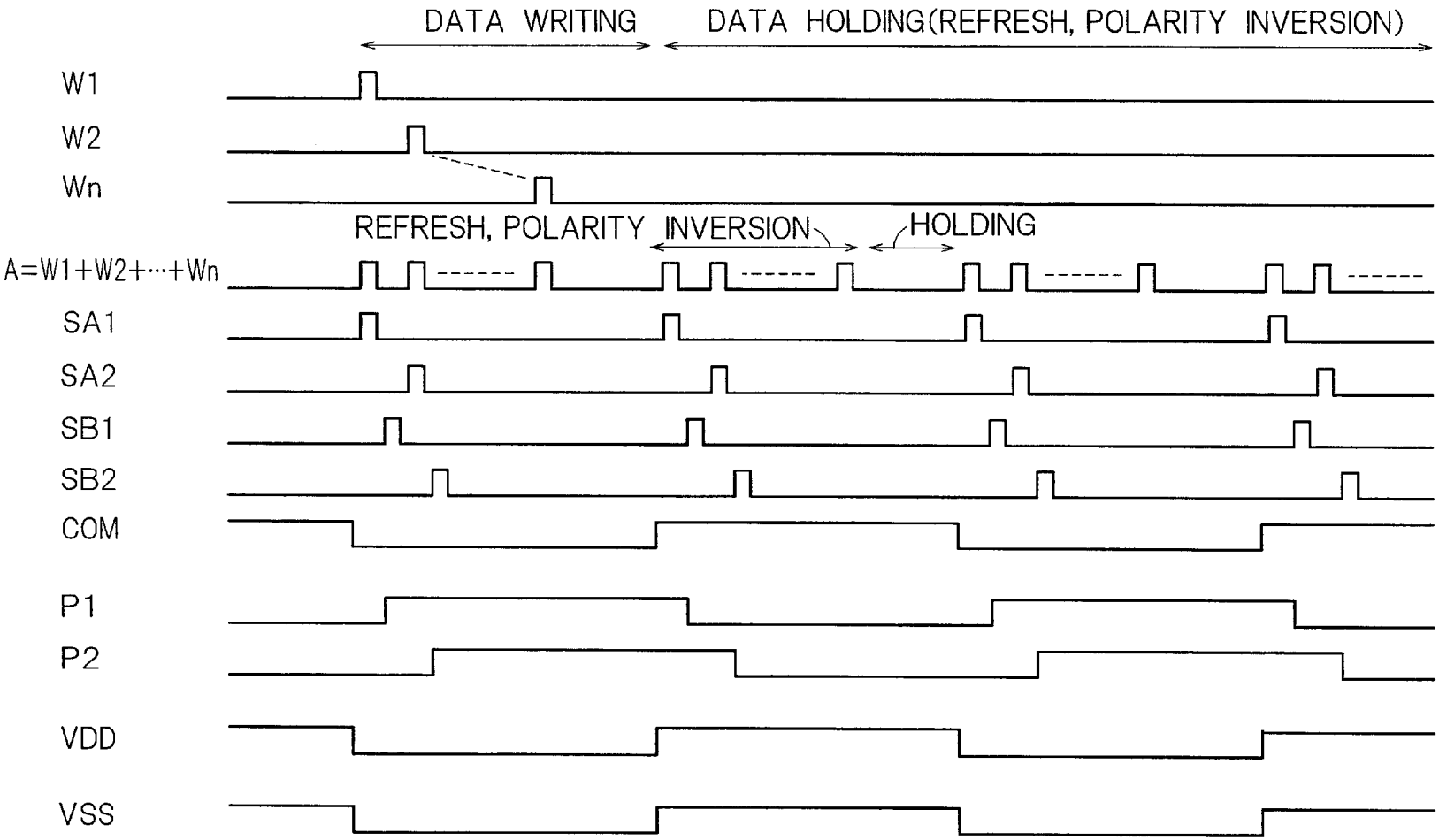
FIG. 18 is a timing chart showing a structure of a DRAM 71 illustrated in FIG. 17C.

FIG. 18 is a timing drawing showing the DRAM structure illustrated in FIG. 17C. The operation of FIG. 17C will now be described hereinafter with reference to this drawing. A power supply voltage VDD and a ground voltage VSS oscillate in synchronization with the COM voltage while maintaining a difference between these voltages to 5 V.

The procedure for writing data will be first described. In the case of writing data, data is applied to the auxiliary capacitance Cs and the inverter at the first stage by activating the word line Wi shown in FIG. 17C. At this moment, since the signal A is on the high level, the transistor is in the off state, and the loop of the inverter is cut off.

Subsequently, when the word line Wi is inactivated and the signal A is on the low level, the loop of the inverter is activated, and the voltage level dynamically held in the gate capacitance of the inverter at the first stage is inverted and amplified, thereby obtaining a desired voltage level.

Then, a signal SBi is conducted. As a result, the Cs level is charged on the power supply level. Thereafter, the word line Wi is activated, and the above-described procedure is repeated.

On the other hand, inversion refresh during the data holding period is carried out by the following procedure. In FIG. 17C, when a signal SAi is activated, the voltage level of the auxiliary capacitance Cs is dynamically held at the gate of the inverter at the first stage. When the signal A falls to the low level, the loop of the inverter is activated, and the holding level becomes the power supply level by the amplification operation of the loop. Then, when the signal SBi is activated, the inversion level is written in the auxiliary capacitance Cs. Subsequently, a signal SA(I+1) is activated, and the above-described procedure is repeated.

It is to be noted that refresh of data is executed during a period in which data is not written (blanking period).

FIG. 19 is a view for comparing the power consumption between the case in which the entire memory is rewritten, the case in which the memory is rewritten in units of line, and the case in which the memory is rewritten in units of line and row. As shown in the drawing, power consumption is maximized in the case in which the entire memory is rewritten, and it is next large in the case in which the memory is rewritten in units of line, and it is least in the case where the memory is rewritten in units of line and row as similar to this embodiment.

Figure 20:
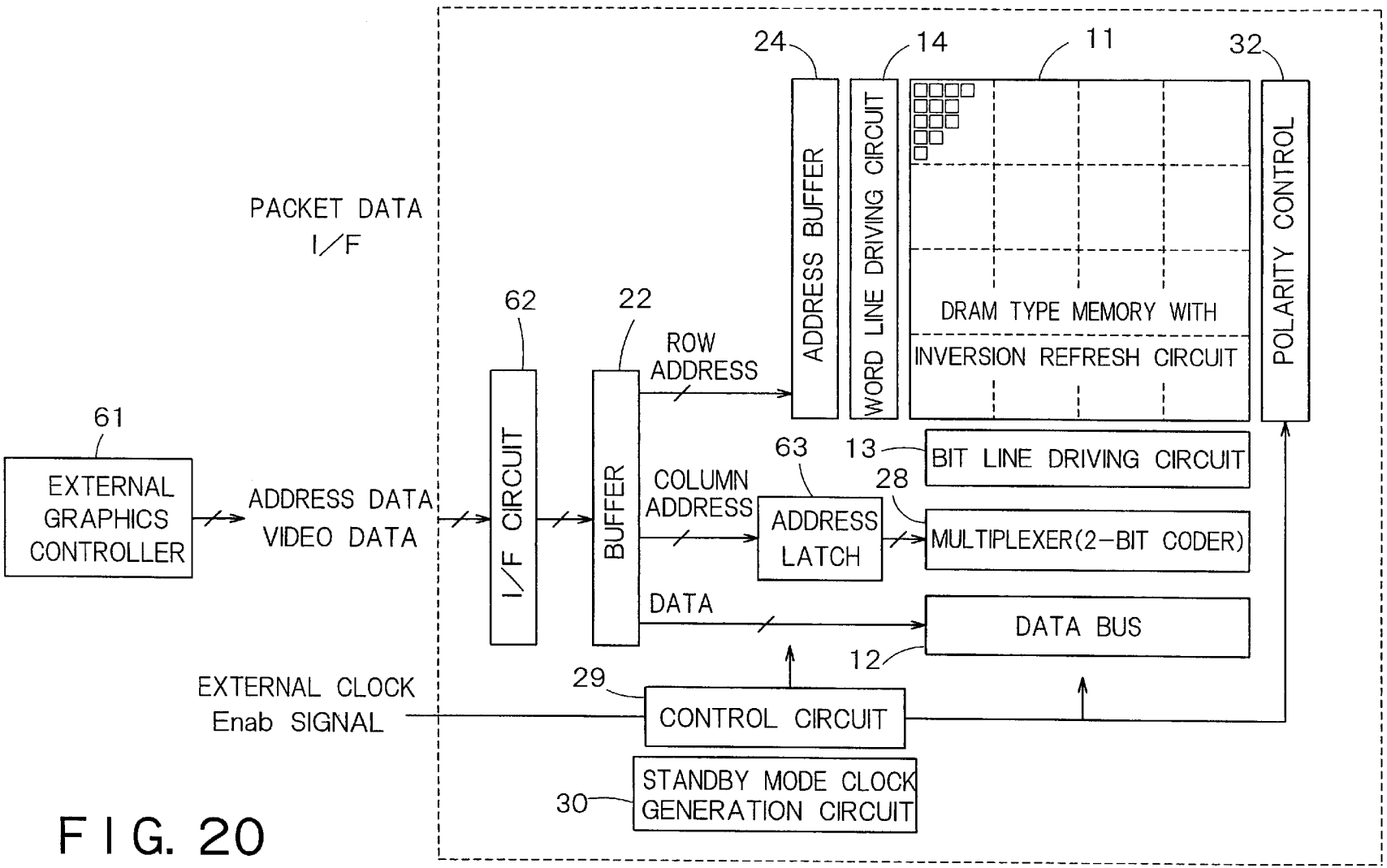
FIG. 20 is a block diagram showing a schematic configuration of a liquid crystal display when a pixel array portion 1 is composed of utilizing a one-bit memory having the DRAM 71 structure.

FIG. 20 is a block diagram showing schematic configuration of a liquid crystal display when the one-bit memory having the DRAM structure is utilized to compose the pixel array portion 1. Although the circuit configuration shown in FIG. 20 is basically the same as that depicted in FIG. 5, it is different from the circuit configuration of FIG. 5 in that a DRAM having an inversion refresh circuit is provided to the pixel array portion 1. By providing the DRAM structure, the circuit configuration can be further simplified as compared with the SRAM structure and the power consumption can be also reduced.

Although the above has described display based on the logic level stored in the one-bit memory in detail, it is possible to also adopt the usual displaying means for D/A-converting the digital video signal into the analog voltage level, applying the analog voltage level to the data line and writing the obtained result into the liquid crystal capacitance or the Cs capacitance. Each sub pixel can be determined as a four-bit memory. Additionally, the four-bit low-power consumption display based on the memory can be realized in the standby display mode, and 6- to 8-bit display obtained by D/A conversion can be realized in the moving picture display mode. Furthermore, the display layer according to the present invention is not restricted to the liquid crystal layer, and an EL layer and the like may be used.

A preferred specific example of the liquid crystal display according to the first embodiment will now be described with reference to FIG. 1.

This liquid crystal display is of a light reflex type in the four-inch diagonal size used for PDA, which includes a display area of a total pixel number 320 (×3)×480.

Figure 21:
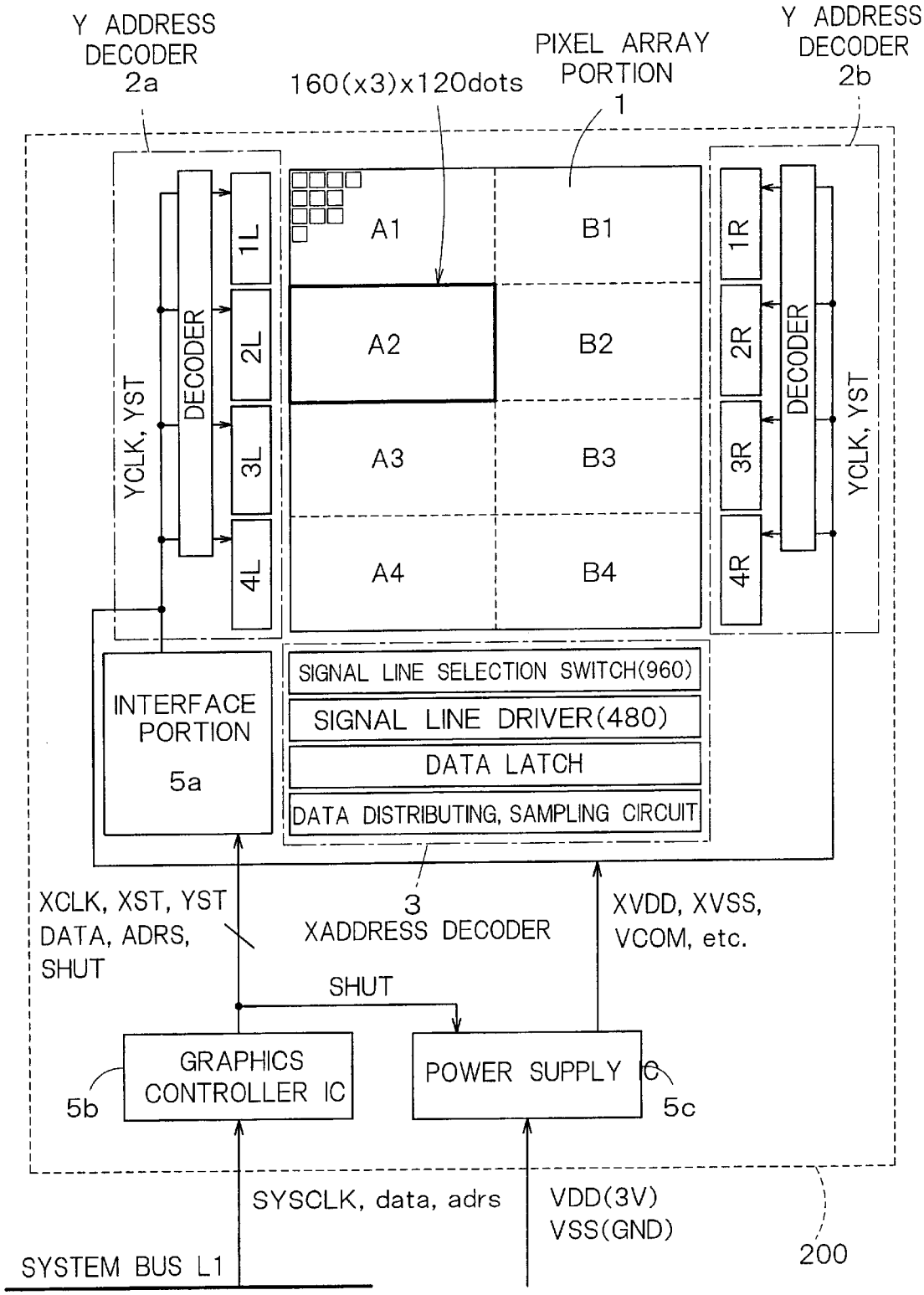
FIG. 21 is a block diagram showing a schematic configuration of the liquid crystal display when the pixel array portion 1 is composed of utilizing a memory having the DRAM 71 structure.
Figure 22:
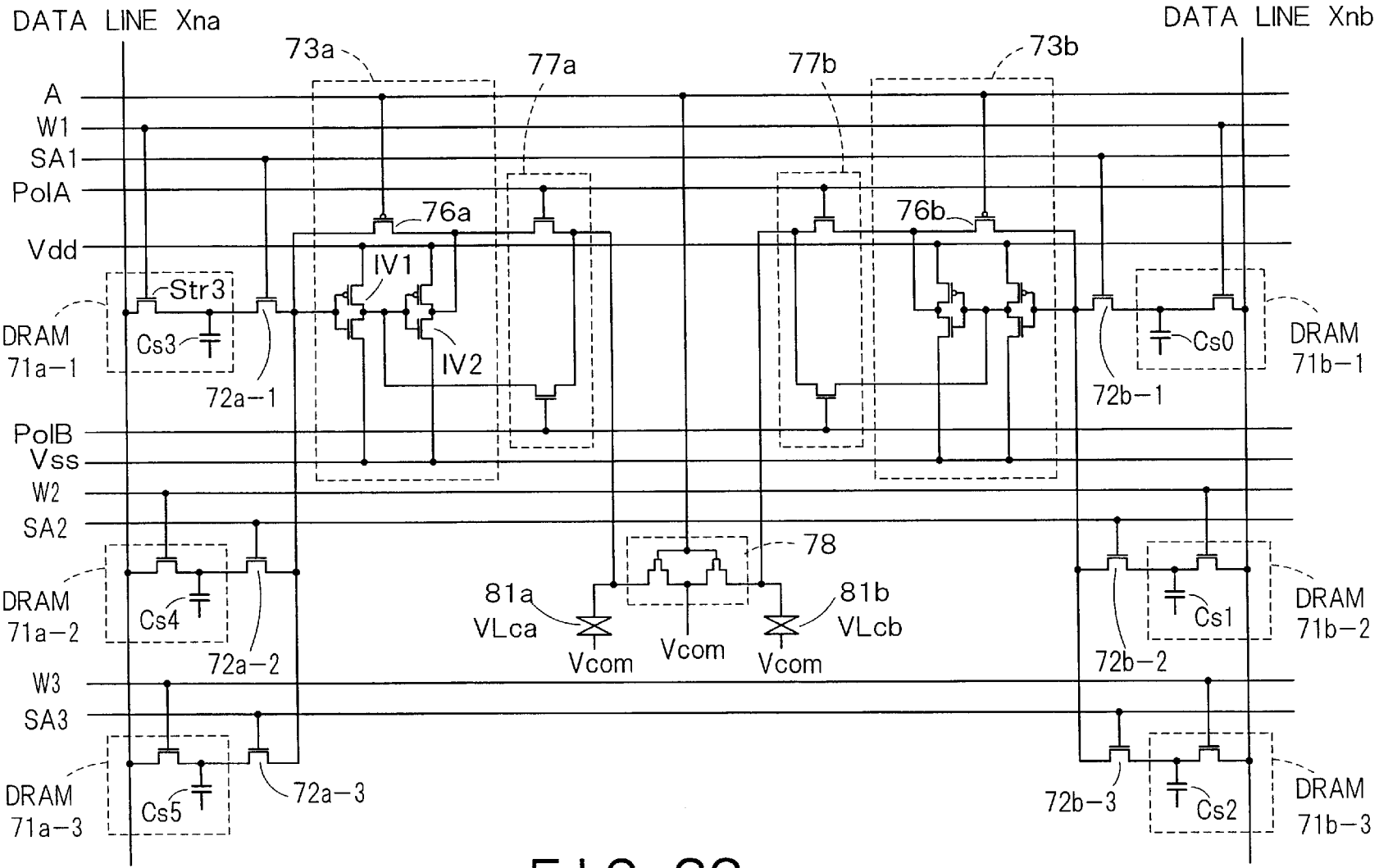
FIG. 22 is a view showing a schematic configuration of one display pixel illustrated in FIG. 21.
Figure 23:
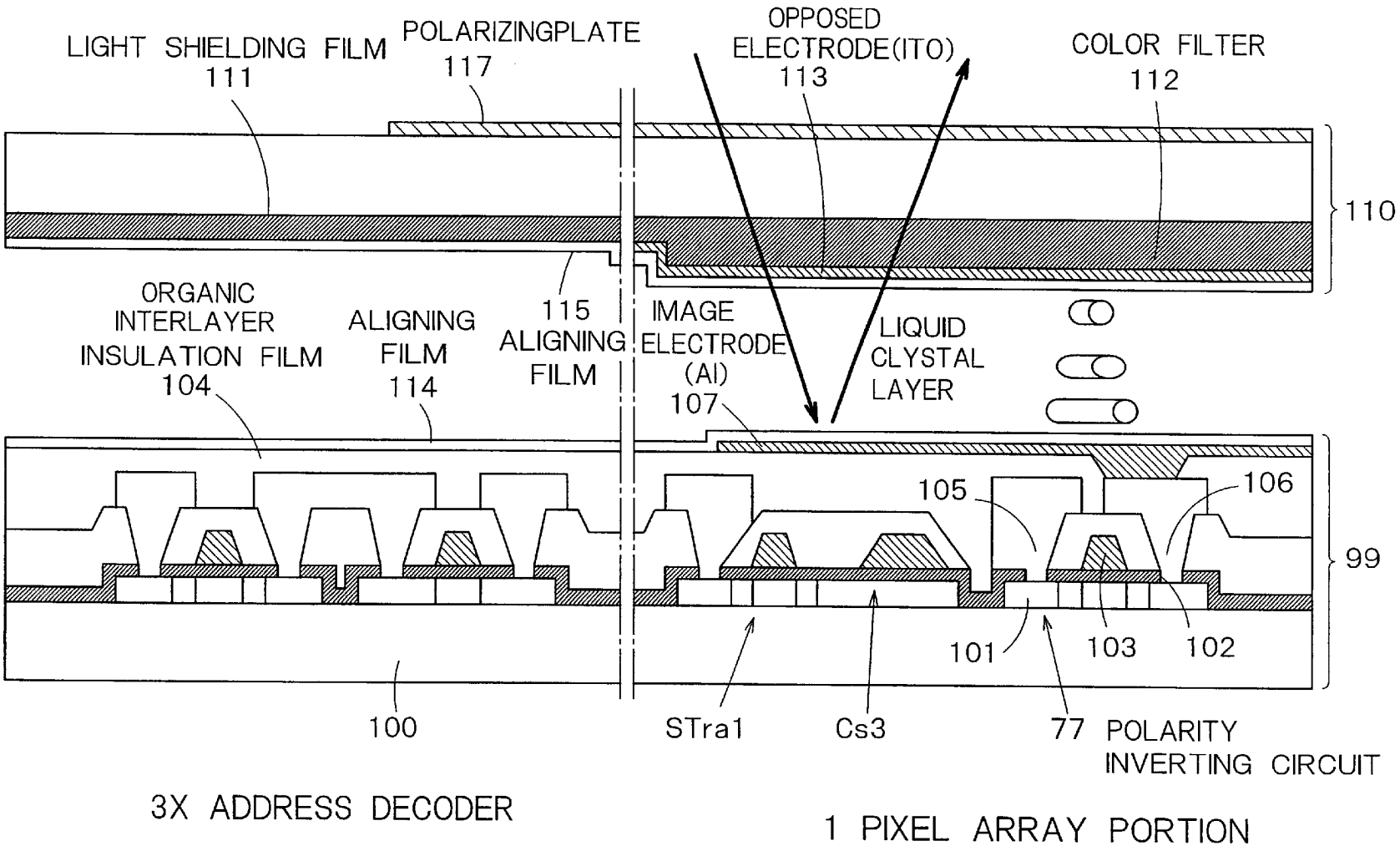
FIG. 23 is a view showing a schematic configuration of the liquid crystal display illustrated in FIG. 21.

FIG. 21 is a view of this liquid crystal display, FIG. 22 is a view showing schematic configuration of the display area, and FIG. 23 is a partially schematic cross-sectional view of the liquid crystal display.

This liquid crystal display is formed on an array substrate 200 formed of e.g. a glass, as an insulating substrate. A display array portion 1, a pair of Y address decoders 2*a* and 2*b*, an X address decoder 3 and an interface portion 5*a* including a part of functions of the VRAM controller 5 depicted in FIG. 1 are integrally formed by, e.g., a polycrystalline silicon transistor (p-Si TFT) on the array substrate 200.

When the above-described interface portion 5*a* is integrally formed on the array substrate 200, the number of output pins of a later-described graphic controller IC 5*b* can be reduced, thereby putting the price of the graphic controller IC 5*b* down. Also, the later-described operation of the graphic controller IC 5*b* can be stopped, thereby attaining the further low power consumption.

Besides, the graphic controller IC 5*b* in which a part of functions of the VRAM controller 5 shown in FIG. 1 and a display memory (VRAM) 4 are contained together in one package and a power supply IC 8 including a power supply circuit such as a DC/DC converter are mounted on the array substrate 200 by COG (chip on glass).

The graphic controller IC 5*b* is directly connected to a system bus L1. The power supply IC 8 is connected to a non-illustrated external power supply and receives a drive voltage VDD of 3 V and a ground voltage VSS from the external power supply.

The display array portion 1 is composed of sub pixels 320 (×3)×480 in total as described above, and it is divided into right and left parts in the display area. Moreover, it is divided into eight blocks (A1 to 4, B1 to 4) composed of 160 (×3)×120 pixels separated into four parts in the vertical direction. The left blocks (A1 to 4) in the display array portion 1 are controlled by a Y address decoder 2*a*, and right blocks (B1 to 4) are controlled by a Y address decoder 2*b*.

Each display pixel composing the display array portion 1 includes sub display image electrodes 81*a* and 81*b* having an area ratio of 2:1, as shown in FIG. 22. A liquid crystal capacitance CLca is formed between the first sub display image electrode 81*a* and an opposed electrode Vcom, and a liquid crystal capacitance CLcb is formed between the second sub display image electrode 81*b* and the opposed electrode Vcom.

In accordance with the first sub image electrode 81*a*, there are provided DRAMs 71*a*-1, 71*a*-2, and 71*a*-3 for storing pixel data DATA corresponding to three bits, transfer TFTs 72*a*-1, 72*a*-2 and 72*a*-3 provided in accordance with the respective DRAMs 71*a*-1, 71*a*-2 and 71*a*-3, a refresh circuit 73*a* commonly provided to the respective DRAMs 71*a*-1, 71*a*-2 and 71*a*-3, and a polarity inverting circuit 77*a* arranged between the first sub image electrode 81*a* and the refresh circuit 73*a*.

Additionally, in accordance with the second sub image electrode 81*b* having an area which is ½ of that of the first sub image electrode 81*a*, there area provided DRAMs 71*b*-1, 71*b*-2 and 71*b*-3 for storing pixel data for three bits, transfer TFTs 72*b*-1, 72*b*-2 and 72*b*-3 provided in accordance with the respective DRAMs 71*b*-1, 71*b*-2 and 71*b*-3, a refresh circuit 73*b* commonly provided to the respective DRAMs 71*b*-1, 71*b*-2 and 71*b*-3, and a polarity inverting circuit 77*b*.

Furthermore, a discharge circuit 78 for discharging electrical charges held in the liquid crystal capacitances CLca and CLcb is provided between the first sub display image electrode 81*a* and the second display image electrode 81*b*.

Each of the DRAMs 71*a*-1, 71*a*-2, 71*a*-3, 71*b*-1, 71*b*-2 and 71*b*-3 has sampling transistors STr1 to STr5 and capacitances Cs0 to Cs5.

The refresh circuits 73*a* and 73*b* are connected to the voltage lines of 0 V (Vss) and 5 V (Vdd), and have two inverters IV1 and IV2 connected in series and feedback TFTs 76*a* and 76*b* connected between the input terminal of the inverter IV1 at the first stage and the output terminal of the inverter IV2 at the rear stage. Furthermore, the output terminal of the inverter IV1 at the front stage and the output terminal of the inverter IV2 at the rear stage are connected to the polarity inverting circuit 77.

The operation of the liquid crystal display depicted in FIG. 21 will now be described.

The liquid crystal display shown in FIG. 21 realizes 64-gradation display based on the six-bit video data by driving in which area gradation (each display picture is composed of the two sub display image electrodes 81*a* and 81*b*) and pulse width modulation (three sub frame periods having different lighting times period are provided in one frame, and a ratio of the light time of the respective sub frame (first to third display) periods is determined as 1:2:4).

Since each display pixel includes the DRAM, the operation of the peripheral driving circuit can be stopped when displaying a still picture and the like, thereby enabling low power consumption. Moreover, since partial rewriting of the display screen is enabled by the independent control for eight blocks in the display area, the operation of the peripheral driving circuit can be partially stopped, thereby further lowering the power consumption.

More specifically, the graphic controller IC outputs a pause signal SHUT to the power supply IC 8 during a period in which no frame memory in the graphic controller IC is updated, and the power supply IC 8 stops power supply of some blocks based on this output in order to reduce power consumption.

Description will be first given as to the case where video data "data" is not inputted to the graphic controller IC.

In the conventional liquid crystal display, even if no video data "data" is inputted to the graphic controller IC, the graphic controller IC constantly outputs pixel data corresponding to one frame. In the liquid crystal display according to this embodiment, however, since each pixel includes the memory, all outputs of the video data "data" from the graphic controller IC can be stopped. Moreover, in connection with this, the operation of the X address decoder can be also stopped, and outputs from the power supply it can be likewise partially stopped, thereby realizing low power consumption.

Figure 24:
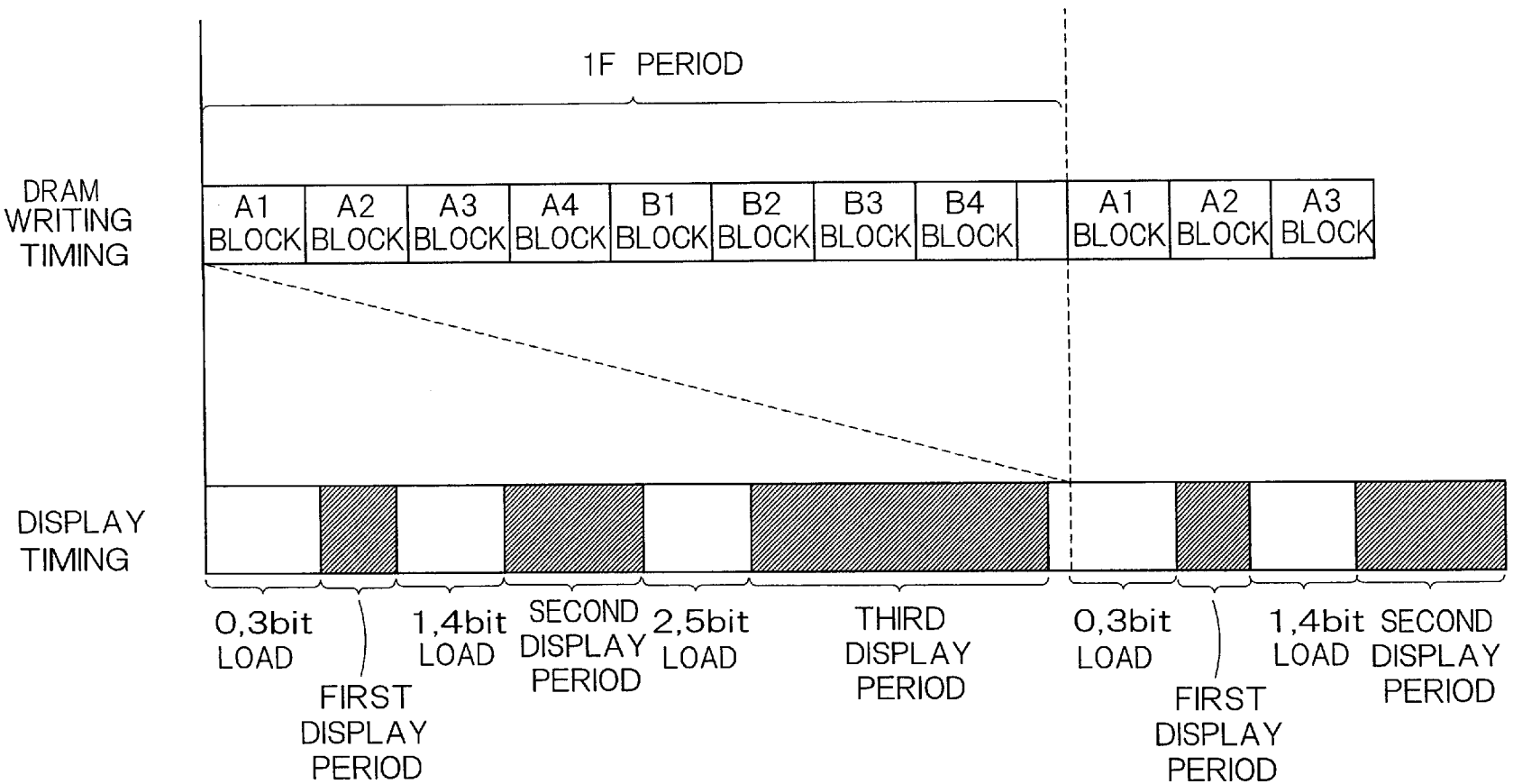
FIG. 24 is a view showing a drive timing for the liquid crystal display depicted in FIG. 21.
Figure 25:
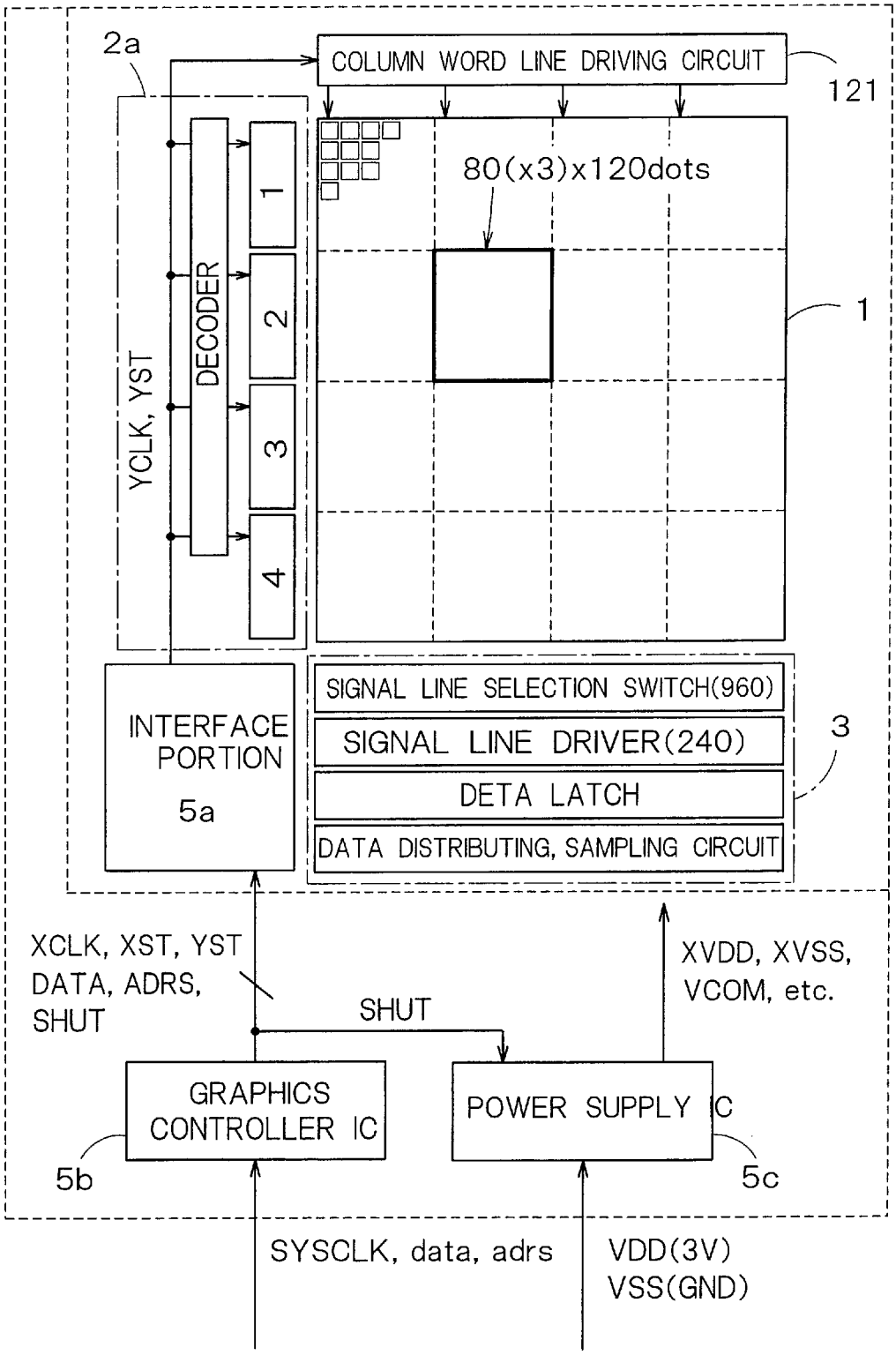
FIG. 25 is a block diagram showing a schematic configuration of another liquid crystal display when the pixel array portion 1 is composed of utilizing a memory having the DRAM 71 structure.

FIG. 24 is a view showing the display timing in one frame period of this display pixel. A display of one display pixel in, e.g., a block A2 will be described with reference to FIG. 24.

In a period from the time t1 to t2, data at the zeroth bit (for example, "0") is held in the capacitance Cs0 of the DRAM 71*b*-1 through the data line Xnb, and data at the third bit (for example, "1") is held in the capacitance Cs3 of the DRAM 71*a*-1 through the data line Xna.

Thereafter, in a period from the time t2 to t3 (first display period), a polarity signal PolA inputted to the polarity inverting circuit 77 is set on the high level and the signal PolB is set on the low level. In addition, a voltage of 5 V (Vdd) is applied to the first sub display image electrode 81*a*, and a voltage of 0 V (Vss) is applied to the second sub display image electrode 81*b*, respectively. At this moment, a voltage of the opposed electrode is set to 0 V. As a result, in the first display period (time t2 to t3), light is transmitted through an area corresponding to the first sub display image electrode 81*a*, and light is prevented from being transmitted through an area corresponding to the second sub display image electrode 81*b*.

Then, in a period from the time t3 to t4, a control signal A is set on the high level, and the potentials of the first and second sub display image electrodes 81*a* and 81*b* are short-circuited to the opposed electrode potential Vcom. Consequently, the electrical charges held in the liquid crystal capacitances CLca and CLcb are temporarily discharged. Additionally, data at the first bit (for example, "1") is held in the capacitance Cs1 of the DRAM 71*b*-2 through the data line Xnb, and data at the fourth bit ("0") is held in the capacitance Cs4 of the DRAM 71*a*-2 through the data line Xna.

Thereafter, in a period from the time t4 to t5 (second display period), the polarity signal PolA inputted to the polarity inverting circuit 77 is set on the high level, and the signal PolB is set on the low level. Also, a voltage of 0 V (Vss) is applied to the first sub display image electrode 81*a*, and a voltage of 5 V (Vdd) is applied to the second sub display image electrode 81*b*, respectively. Incidentally, at this moment, a voltage of the opposed electrode is set to 0 V as similar to the first display period. Consequently, in the first display period (time t2 to t3), light is prevented from being transmitted through an area corresponding to the first sub display image electrode 81*a*, and light is transmitted through an area corresponding to the second sub display image electrode 81*b*.

Subsequently, in a period from the time t5 to t6, the control signal A is set on the high level, and potentials of the first and second sub display image electrodes 81*a* and 81*b* are short-circuited to the opposed electrode potential Vcom. As a result, the electrical charges held in the liquid crystal capacitances CLca and CLcb are temporarily discharged. Furthermore, data at the first bit (for example, "1") is held in the capacitance Cs2 of the DRAM 71*b*-3 through the data line Xnb, and data at the fourth bit ("0") is held in the capacitance Cs5 of the DRAM 71*a*-3 through the data line Xna.

Subsequently, in a period from the time t6 to t7, the polarity signal PolA inputted to the polarity inverting circuit 77 is set on the high level, and the signal PolB is set on the low level. Also, a voltage of 5 V (Vdd) is applied to the first sub display image electrode 81*a*, and a voltage of 0 V (Vss) is applied to the second sub display image electrode 81*b*, respectively. Incidentally, at this moment, a voltage of the opposed electrode is set to 0 V. Consequently, in the first display period (time t2 to t3), light is transmitted through an area corresponding to the first sub display image electrode 81*a*, and light is prevented from being transmitted through an area corresponding to the second sub display image electrode 81*b*.

As described above, in this embodiment, 64-gradation display based on the six-bit video data is realized by driving in which the two sub display image electrodes 81*a* and 81*b* for realizing the area gradation and the first to third display periods in one frame period for realizing pulse width modulation (a ratio of light time between the first to third display periods is 1:2:4) are combined.

It is to be noted that, in the subsequent frame period, the polarity signal PolA inputted to the polarity inverting circuit 77 is set on the low level, PolB is set on the high level, a voltage of the opposed electrode is set to 5 V. Therefore, the polarity of the voltage applied to the liquid crystal can be inverted while maintaining the same display state, thereby preventing burning.

As described above, in the liquid crystal display shown in FIG. 21, when the video data "data" is not inputted to the graphic controller IC, the operation of the X address decoder can be completely stopped, and display can be maintained by the pixel data DATA held in the built-in DRAM.

Description will now be given as to the cases in which the video data "data" is inputted to the graphic controller IC after the above-described display state continues, i.e. the cases in which display of the block A1 in the display area is partially changed.

The video data "data" and address data adrs for this video data "data" are inputted together with a system clock SYSCLK to the graphic controller IC from the CPU 6 (see FIG. 1) through the system bus L1. The graphic controller IC sequentially updates the frame memory in the graphic controller IC based on the address data adrs.

The graphic controller IC outputs an X clock XCLK and an X start XST for controlling the X address decoder 3 based on the inputted system clock SYSCLK, and outputs a Y start YST for controlling the Y address decoder to the interface portion 5*a*. Furthermore, the graphic controller IC outputs to the interface portion 5*a* pixel data DATA of the block A1 corresponding to the updated video data "data" and address data ADRS indicative of a coordinate of the block A1.

The interface portion 5*a* generates a Y clock YCLK based on the inputted X clock, outputs the Y clock YCLK and the Y start YST to the Y address decoders 2*a* and 2*b*, and outputs the X clock XCLK and the X start XST to the X address decoder 3. Moreover, based on the pixel data DATA and the address data ADRS in units of the inputted block, the interface portion 5*a* outputs the Y address data YADRS to the Y address decoder 2*a* and 2*b* and also outputs the pixel data DATA and X address data XADRS to the X address decoder 3.

The X address decoder 3 samples data corresponding to one horizontal pixel line in the block A2 in an H/2 period by a sampling circuit SP based on the inputted pixel data DATA and the X address data XADRS, and holds the pixel data DATA in a data latch DL. Then, the X address decoder 3 sequentially outputs the corresponding pixel data DATA to the data lines Xna and Xnb corresponding to the block A2 in the order of the respective bits through a data line driver XDR and a data line selection switch XSW.

A decode portion DC of each of the Y address decoder 2*a* and 2*b* activates only a controller 2L corresponding to the block A2 based on the inputted Y address data YADRS, and the controller 2L outputs signals (A, W1 to W3, SA1 to SA3, PolA and PolB) to the corresponding pixels.

In the timing of the block A2 shown in FIG. 24, the six-bit pixel data DATA is sequentially supplied to the data lines Xna and Xnb corresponding to the block A2 from the X address decoder 3. Moreover, sampling pulses W1 are sequentially supplied from the Y address decoder 2*a*. As a result, the zeroth bit of the six-bit DATA is held in the capacitance Cs0 of the DRAM 71*b*-1, and the third bit of the same is held in the capacitance Cs3 of the DRAM 71*a*-1. Subsequently, when the sampling pulse W2 is supplied, the first bit of the six-bit DATA is held in the capacitance Cs1 of the DRAM 71*a*-2, and the fourth bit of the same is held in the capacitance Cs4 of the DRAM 71*b*-2. Then, when the sampling pulse W3 is supplied, the second bit of the six-bit DATA is held in the capacitance Cs2 of the DRAM 71*b*-3, and the fifth bit of the same is held in the capacitance Cs5 of the DRAM 71*a*-3.

For example, as different from the above-described display state, it is assumed that data at the zeroth bit "1" is held in the capacitance Cs0, data at the first bit "0" is held in the capacitance Cs1, data at the second bit "1" is held in the capacitance Cs2, data at the third bit "0"is held in the capacitance Cs3, data at the fourth bit "1" is held in the capacitance Cs4, and data at the fifth bit "0" is held in the capacitance Cs5 in the DRAMs 71*b*-1, 71*b*-2, 71*b*-3, respectively.

Incidentally, according to the structure of this embodiment, since the respective DRAMs 71*a*–*b* to 71*b*-3 and the refresh circuits 73*a* and 73*b* for supplying electric currents to the sub display image electrodes 81*a* and 81*b* are electrically separated from each other by the transfer transistors 72*a*-1 to 72*b*-3 in the sampling operation, the sampling operation can be carried out independently from the display operation. Therefore, the DRAMs 71*a*-1 to 71*b*-3 can be refreshed concurrently with the display operation, and it is not necessary to additionally provide a refresh period.

In the load period at the zeroth bit and the third bit shown in FIG. 24, the transfer transistors 72*a*-1 and 72*b*-1 become conductive by the transfer pulse SA1.

For example, in the first display period (the time t2 to t3 in FIG. 24), the polarity signal PolA inputted to the polarity inverting circuit 77 is set on the high level, and the signal PolB is set on the low level. Also, a voltage of 0 V (Vss) is applied to the first sub display image electrode 81*a*, and a voltage of 5 V (Vdd) is applied to the second sub display image electrode 81*b*, respectively. It is to be noted that a voltage of the opposed electrode is set to 0 V at this moment. As a result, in the first display period, light is prevented from being transmitted through an area corresponding to the first sub display image electrode 81*a*, and light is transmitted through an area corresponding to the second sub display image electrode 81*b*.

Thereafter, at the time t3 to t4 in FIG. 24, the control signal A is set on the high level, and potentials of the first and second sub display image electrodes 81*a* and 81*b* are short-circuited to the opposed electrode potential Vcom. Consequently, the electrical charges held in the liquid crystal capacitances CLca and CLcb are temporarily discharged. Furthermore, data at the first bit (for example, "1") is held in the capacitance Cs1 of the DRAM 71*b*-2 through the data line Xnb, and data at the fourth bit ("0") is held in the capacitance Cs4 of the DRAM 71*a*-2 through the data line Xna.

Subsequently, in a period from the time t4 to t5 (second display period), the polarity signal PolA inputted to the polarity inverting circuit 77 is set on the high level and the signal PolB is set on the low level. Also, a voltage of 5 V (Vdd) is applied to the first sub display image electrode 81*a*, and a voltage of 0V (Vss) is applied to the second sub display image electrode 81*b*, respectively. Incidentally, at this moment, a voltage of the opposed electrode is set to 0 V as similar to the first display period. As a result, in the first display period (time t2 to t3), light is transmitted through an area corresponding to the first sub display image electrode 81*a*, and light is prevented from being transmitted through an area corresponding to the second sub display image electrode 81*b*.

Thereafter, in a period from the time t5 to t6, the control signal A is set on the high level, and the potentials of the first and second sub display image electrodes 81*a* and 81*b* are short-circuited to the opposed electrode potential Vcom. Consequently, the electrical charges held in the liquid crystal capacitances CLca and CLcb are temporarily discharged. Furthermore, data at the first bit (for example, "1") is held in the capacitance Cs2 of the DRAM 71*b*-3 through the data line Xnb, and data at the fourth bit ("0") is held in the capacitance Cs5 of the DRAM 71*a*-3 through the data line Xna.

Then, in a period from the time t6 to t7 (third display period), the polarity signal PolA inputted to the polarity inverting circuit 77 is set on the high level, and the signal PolB is set on the low level. Also, a voltage of 0V (Vss) is applied to the first sub display image electrode 81*a*, and a voltage of 5V (Vdd) is applied to the second sub display image electrode 81*b*, respectively. Incidentally, at this moment, a voltage of the opposed electrode is set to 0V. Consequently, in the first display period (time t2 to t3), light is prevented from being transmitted through an area corresponding to the first sub display image electrode 81*a*, and light is transmitted through an area corresponding to the second sub display image electrode 81*b*.

It is to be noted that any other block to which no data is inputted maintains display based on the pixel data held in the DRAM as described above.

As mentioned above, according to the liquid crystal display of this embodiment, the built-in six bits memory, the area gradation (each display pixel is composed of two sub display image electrodes 81*a* and 81*b*), and the pulse width modulation (three sub frame periods having different lighting times are provided in one frame period, and a ratio of the light time of the respective sub frame (first to third display) periods is determined as 1:2:4) are combined. Therefore, the operation of the X address decoder can be completely stopped, and 64-gradation display can be realized, thereby greatly reducing the power consumption.

Furthermore, since the display area is two-dimensionally divided into a plurality of blocks and the divided blocks can be independently controlled, partial area rewriting can be realized with the minimized circuit operation, and the power consumption can be considerably reduced.

In this embodiment, the polarity of the voltage applied to the liquid crystal is inverted by every one frame in order to prevent deterioration of the display quality. However, the period which allows the polarity of the voltage to invert is not restricted to one frame, and the polarity of the voltage may be inverted by every one horizontal pixel line or every multiple horizontal pixel lines, thereby suppressing flicker although the power consumption is increased.

Moreover, in this embodiment, the number of power supply voltages inputted to the inverter can be reduced to two by using so-called common reverse driving for causing the potential of the opposed electrode to fluctuate in the frame period, thereby simplifying simplification of the structure of the array substrate.

Meanwhile, in this embodiment, the Y address decoder is arranged on the left and right sides of the pixel array portion 1 in order to divide the pixel array portion 1 into two. Besides, for example, if a row word line driving circuit is provided, it is possible to arbitrarily determine the number of division in the horizontal direction, and to divide the pixel array portion 1 into smaller blocks. That is, although a corresponding block is uniquely determined by designation of the Y address decoder in the foregoing embodiment, a corresponding block is determined by designation of both the Y address decoder and the row word line driving circuit in this embodiment.

The structure of the liquid crystal display shown in FIG. 21 will now be complemented with reference to FIG. 23. TFTs composing respective circuit blocks and the like are formed on the insulating substrate 100 composed of glass with polycrystalline silicon (p-Si) 101 as an active layer. An LDD structure is adopted for the N-channel TFT in order to reduce a leak electric current. A gate insulating film 102 composed of silicon oxide film is arranged on the polycrystalline silicon (p-Si) 101, and a gate electrode 103 made of MoW alloy and the like is arranged on the gate insulating film 102. Source and drain electrodes 105 and 106 electrically connected to the polycrystalline silicon (p-Si) 101 are arranged on the gate electrode 103 through an interlayer insulating film 104 composed of a silicon oxide film.

Moreover, an interlayer insulating film 104 which is made of acrylic resin and has a film thickness of approximately 3 μm is arranged on the source and drain electrodes 105 and 106, and a image electrode 107 as a reflecting electrode composed of A1 is arranged on the interlayer insulating film 104, thereby composing an array substrate 99.

An opposed substrate 110 which is opposed to the array substrate 99 has a light shielding film 111 composed of a metal such as Cr or black resin on the glass substrate, a color filter 112 of red, blue and green in the light shielding film 11, and an opposed electrode 113 composed of a transparent electrode such as ITO.

In addition, a liquid crystal layer 116 is held between the array substrate 99 and the opposed substrate 113 through orientation films 114 and 115, and a polarizing plate 117 is arranged on the opposed substrate 113.

As the liquid crystal layer 116, ferroelectric liquid crystal having the excellent responsibility, OCB liquid crystal and others as well as twist nematic liquid crystal can be preferably used.

Additionally, as display modes of liquid crystal, a transmission type as well as the above-described reflection type may be used. Also, it is possible to apply to various display modes such as a reflection/transmission type that an opening is formed to the reflecting electrode and both reflection and transmission are performed, or a semi-transmission type using a selected reflecting film such as cholesteric liquid crystal.

(Second Embodiment)

A second embodiment is an example in which an EL (electroluminescence) device is used as a display device.

Figure 26:
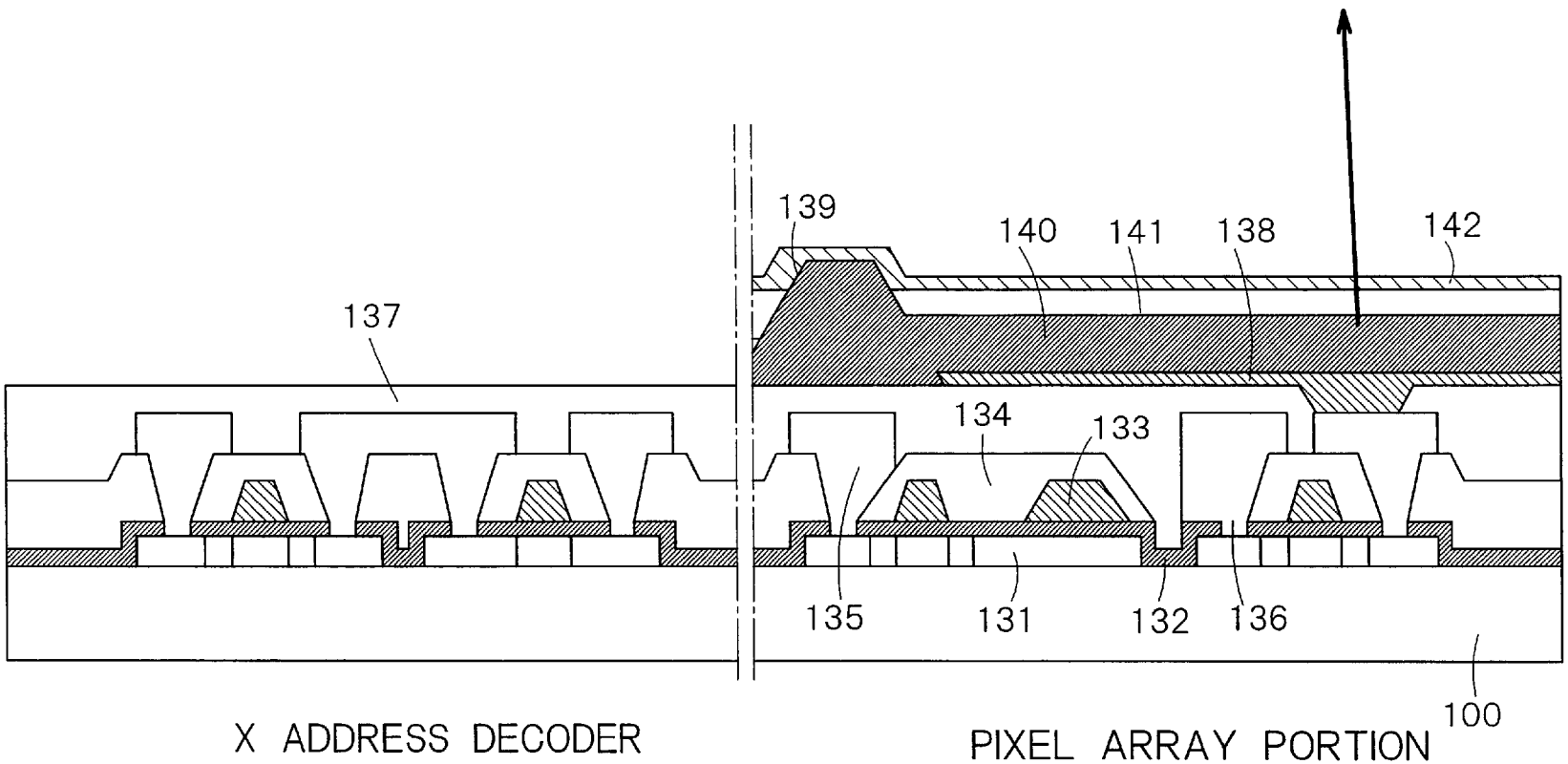
FIG. 26 is a schematic cross-sectional view of an EL device.

This EL device is formed with polycrystalline silicon (p-Si) as an active layer 131 being provided on an insulating substrate 100 composed of glass as shown in FIG. 26, and the N-channel TFTs are formed of an LDD structure in order to reduce the leak electric current. A gate insulating film 132 composed of a silicon oxide film is arranged on the polycrystalline silicon (p-Si), and a gate electrode 133 composed of Mow alloy and the like is arranged on the gate insulating film 132. Additionally, source and drain electrodes 135 and 136 which are electrically connected to polycrystalline silicon (p-Si) through an interlayer insulating film 134 made up of a silicon oxide film are arranged on the gate electrode 133. Furthermore, an interlayer insulating film 137 which is composed of acrylic resin and the like and has a film thickness of approximately 3 μm is arranged on the source and drain electrodes 135 and 136. A reflective image electrode 138 made up of a laminated body formed of A1 and a transparent electrode such as ITO is arranged on the interlayer insulating film 137.

Furthermore, a pixel separation partition wall 139 composed of acrylic-based black resin is arranged between the image electrodes in order to partition the image electrodes, and a hall injection layer 140 composed of a polymer ion complex is arranged on the image electrodes partitioned by the pixel separation partition wall 139. A light emitting layer 141 composed of conjugate polymer and corresponds to each pixel is arranged on the light emitting layer 141, and a cathode electrode 142 which is composed of a laminated body formed of a thin film alkali earth metal and the transparent electrode such as ITO is arranged on the light emitting layer 141.

As the hall injection layer 140 or the light emitting layer 141, the above-described polymer material is preferable since it can be formed by ink jet coating and realizes the high productivity. However, materials besides the polymer material may be used, and various kinds of low-molecular materials can be preferably used.

Figure 27:
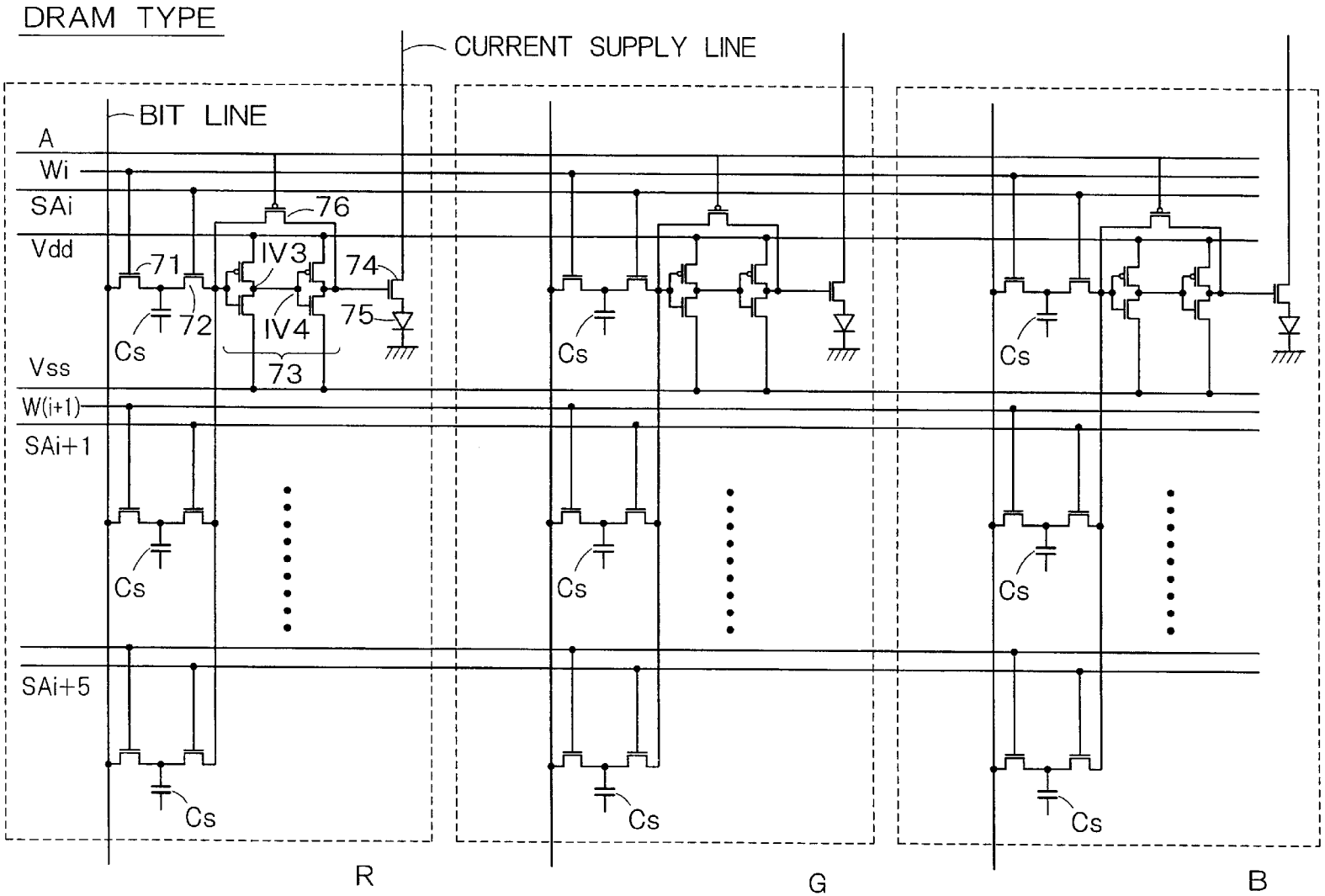
FIG. 27 is a view showing a schematic configuration of a second embodiment of a display device according to the present invention.

FIG. 27 is a view showing schematic configuration of the EL device and shows a structure of an EL display device for one pixel. As shown in the drawing, it is composed of three blocks for red (R), green (G) and blue (B). In each block, there are provided a DRAM 71 for storing pixel data, a transfer TFT 72, a refresh circuit 73, a drive TFT 74 and an EL device 75.

The number of DRAM 71 and the transfer TFT 72 is equal to the number of bits of pixel data. For example, in FIG. 27, six DRAMs 71 and six transfer TFTs 72 are provided, and display of $2^6$=64 gradations is possible.

The refresh circuit 73 has two inverters IV3 and IV4 connected in series and a feedback TFT 76 which is connected between an input terminal of the inverter IV3 at the first stage and an output terminal of the inverter IV4 at the rear stage. The output terminal of the inverter IV4 at the rear stage is connected to a gate terminal of the drive TFT 74, and the EL device 75 is connected to a source terminal of the drive TFT 74.

Six DRAMs 71 and six transfer TFTs 72 are connected to the refresh circuit 73 in parallel. When any transfer TFT 72 is turned on, data of the corresponding DRAM 71 is read and inputted to the refresh circuit 73.

The EL display device shown in FIG. 27 realizes gradation display by controlling the lighting period of the EL device 57. For example, when performing 64-gradation display, as shown in FIG. 28, six sub frame periods having different light times are provided in one frame period, and a ratio of the lighting time of the respective sub frame periods (black parts in the drawing) is determined as 1:2:4:8:16:32. In accordance with a value of the pixel data, whether or not the EL device 75 is lighted in each sub frame period is determined.

Figure 28A:
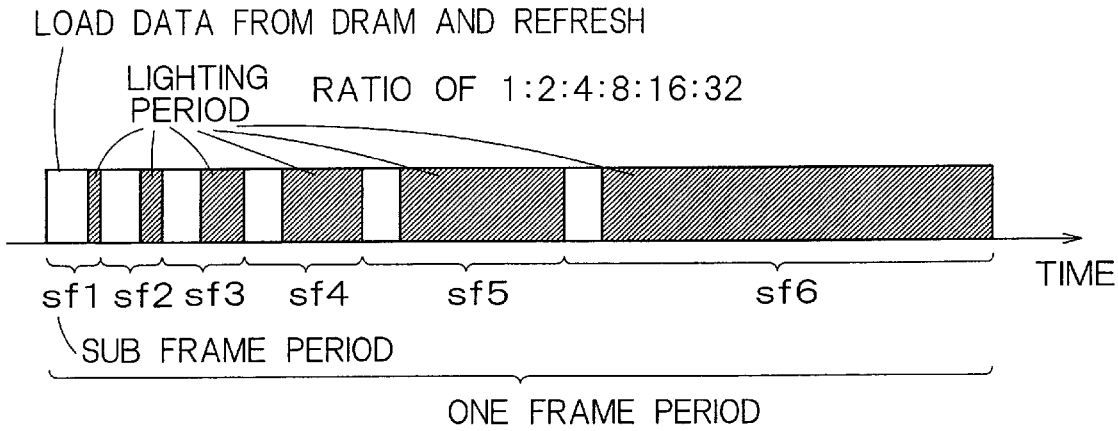
FIG. 28 are views showing the relationship between a frame and a sub frame.
Figure 28B:
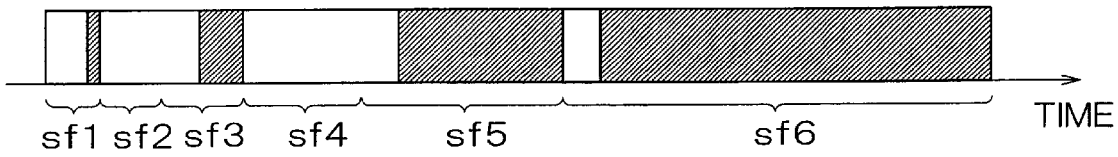

FIG. 28A takes pixels of pixel data (1, 1, 1, 1, 1, 1) as an example and illustrates periods in which the EL device of the pixels is actually lighted for one frame. The EL device portion of the pixels actually emits light in periods indicated by black in the drawing. FIG. 28B takes pixels of pixel data (1, 0, 1, 0, 1, 1) as an example and illustrates periods in which the EL device of the pixels actually emits light for one frame.

The operation of the EL display device shown in FIG. 27 will now be described hereinafter. At the state that the word lines Wi to W (i+5) are sequentially turned on, pixel data is written into the DRAM 71 by sequentially supplying the data to the bit line.

Upon completion of writing data into the DRAM 71, six transfer TFTs 72 are sequentially turned on one by one by controlling the control lines SAi to SA (i+5). More specifically, the transfer TFTs 72 are alternately turned in sequence every sub frame period.

As a result, the data of the DRAMs 71 connected to the transfer TFTs 72 which are turned on is sequentially inputted to the refresh circuit 73. At this moment, the control line A is on the high level, and the feedback TFT 76 is in the off state.

Then, the control line A is set to fall to the low level in order to turn on the feedback TFT 76. Consequently, the refresh operation is carried out in the refresh circuit 73.

Figure 28C:
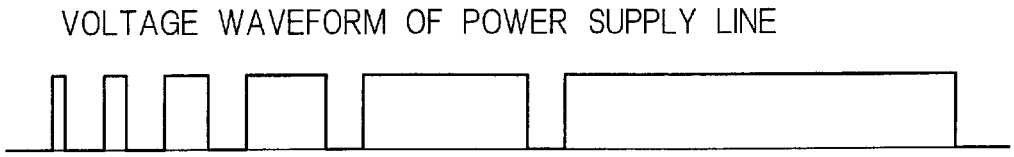

On the other hand, a voltage pulse such as shown in FIG. 28C which has the same cycle as that illustrated in FIG. 28A is supplied to the power supply line. Therefore, when the output of the refresh circuit 73 is on the high level, the drive TFT 74 is turned on, and the EL device 75 emits light during the period indicated by black in FIG. 28A.

The timing for writing the pixel data into the DRAM 71 and the light emission timing of the EL device 75 are not restricted to one pattern, and a plurality of patterns can be considered. For example, FIG. 29A is a timing chart in the case of providing a data updating period of the DRAMs 71 separately from the light emission period of the EL device 75.

Figures 29A, 29B, 29C:
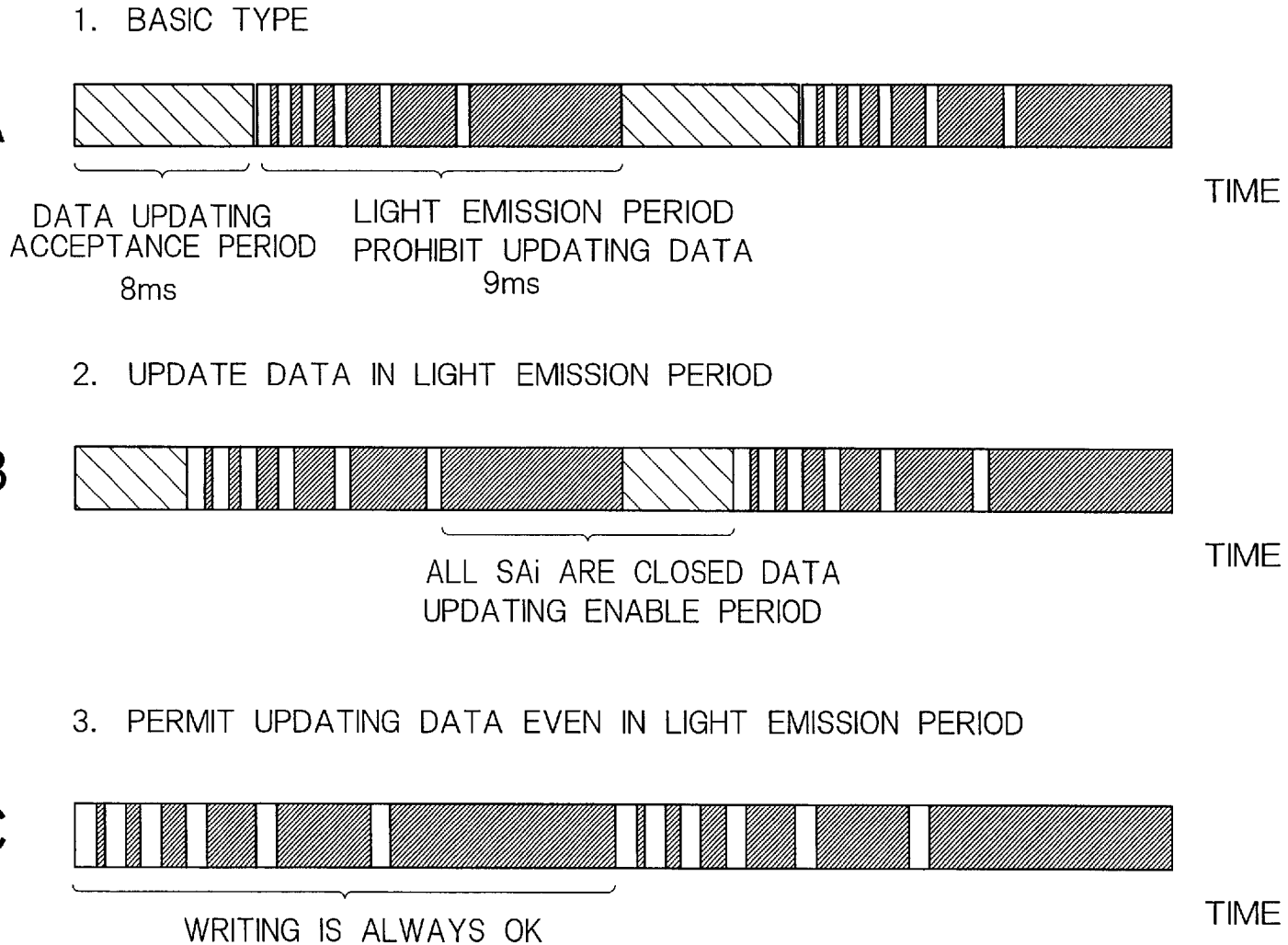
FIGS. 29A–29C are views showing the relationship between a light emitting period and a data updating period.

Furthermore, FIG. 29B shows an example in which a part of the light emission period of the EL device 75 is used for updating data of the DRAM 71. In order to update data in the light emission period, for example, the transfer TFT 72 or the feedback TFT 76 may be turned off.

Moreover, FIG. 29C shows an example in which light emission of the EL device 75 and updating data in the DRAM 71 are carried out in substantially the same timing. In this case, the transfer TFT 72 is turned off immediately after completion of the refresh operation, the DRAM 71 and the refresh circuit 73 are separated from each other, and data in the DRAM 71 is updated. In addition, the memory can be updated completely independently from the light emission period by performing the following operation. That is, even while the transfer TFT 72 applies the voltage of the DRAM 71 to the refresh circuit, the logic for setting SAi to the low level must be determined when the word line Wi is activated. The light emission sequence and the memory updating sequence can be determined in the completely independent cycles. This is enabled by the configuration according to the present invention.

The example shown in FIG. 29B can prolong the light emission period as compared with that in FIG. 29A, and the example shown in FIG. 29C can prolong the light emission period as compared with that in FIG. 29B. In general, the longer light emission period can reduce the power consumption.

Although the input and output of the two inverters as the DRAM and the refresh circuit of the DRAM are connected to the loop in this embodiment, various modifications are enabled if there is provided a circuit having a function for amplifying the logic level of the DRAM 71.

What is claimed is:

1. A display device comprising:

a plurality of display pixels arranged in a matrix form;

a plurality of scanning lines arranged in a row direction of said display pixels;

data lines arranged in a column direction of said display pixels;

a data line driving circuit configured to supply image data to said data lines;

a scanning line driving circuit configured to supply a scanning signal to said scanning lines; and a controller configured to control said data line driving circuit and said scanning line driving circuit, wherein each of said display pixels includes:

a plurality of data bit storages which store the corresponding image data in response to the scanning signal;

a holding circuit which holds one bit data in the image data stored in said plurality of data bit storages, and conducts refresh operation for said plurality of data bit storages;

a lighting controller which controls whether or not to light the display pixels in accordance with a logic of one bit data held in said holding circuit; and a transferring transistor connected between said plurality of data bit storages and said holding circuit, said holding circuit includes:

two inverters connected in series; and a feedback transistor connected between an output terminal of the inverter at a subsequent stage and an input terminal of the inverter at a previous stage, wherein said plurality of display pixels are divided into two or more blocks in each of horizontal and vertical directions, and said display pixels are configured to update image data based on a signal which is transmitted from said controller, said signal including an indicator designating a block for display updating and the pixel data in the block.

2. The display device according to claim 1, wherein said display pixel includes a polarity inverting circuit configured to invert polarity of a pixel voltage based on the corresponding data held in said data bit storages with respect to a reference voltage in a predetermined cycle.

3. The display device according to claim 2, wherein said predetermined cycle is determined based on said scanning signal.

4. The display device according to claim 2, wherein said polarity inverting circuit is connected to a pair of control wirings arranged in the row or column direction, and inverts the polarity based on the control signal inputted to said control wirings.

5. The display device according to claim 4, wherein a pair of said polarity inverting circuits adjacent to each other in a direction orthogonal to said control wirings are commonly connected to a pair of said control wirings.

6. The display device according to claim 1, further comprising:

a plurality of column selection lines arranged in the column direction corresponding to said blocks;

a column selection line driving circuit configured to supply a selection signal to said column selection line;

a sub scanning line arranged in accordance with said display pixels arranged adjacent to each other in the row direction in said block; and a selection controller configured to supply a sub scanning signal to said sub scanning line based on a selection signal supplied to said column selection line and a scanning signal supplied to said scanning line.

7. The display device according to claim 1, wherein said controller supplies a group of the corresponding data of each of said display pixel in said block to be changed, to said data line driving circuit and said signal line driving circuit together with address data of said block.

8. The display device according to claim 1, wherein a pair of said display pixels arranged adjacent to each other in said column direction in said block are commonly arranged in accordance with one of said data lines.

9. The display device according to claim 1, wherein said display pixel is formed by holding a light emitting layer between a pair of electrodes.

10. The display device according to claim 1, wherein said display pixel is formed by holding a liquid crystal layer between a pair of electrodes.

11. The display device according to claim 1, further comprising:

a level shift circuit which shifts signal level of a data signal inputted from outside at low amplitude, wherein the level-shifted data signal is supplied to said data bit storage through said data lines.

12. The display device according to claim 1, wherein said plurality of display pixels are divided into a plurality of blocks having two or more blocks in horizontal direction and two or more blocks in vertical direction, and update pixel data by receiving a signal designating the block for display updating transmitted from said control circuit and the image data of the corresponding block;

said scanning line drive circuit is arranged at both of left side and right side; and said data bit storage has a capacitor, a writing transistor and a read-out transistor.

* * * * *